US006079214A

United States Patent [19]

Bishop

[11] Patent Number: 6,079,214

[45] Date of Patent: Jun. 27, 2000

[54] STANDING WAVE PUMP

[75] Inventor: Richard Patten Bishop, Fairfax Station, Va.

[73] Assignee: Face International Corporation, Norfolk, Va.

[21] Appl. No.: 09/129,813

[22] Filed: Aug. 6, 1998

[51] Int. Cl.[7] ..... F25B 9/00

[52] U.S. Cl. ..... 62/6; 62/467

[58] Field of Search ..... 62/6; 417/322

[56] References Cited

U.S. PATENT DOCUMENTS

| | | | |
|---|---|---|---|
| 5,020,977 | 6/1991 | Lucas | 62/6 |
| 5,357,757 | 10/1994 | Lucas | 62/6 |
| 5,701,743 | 12/1997 | Hagiwara et al. | 62/6 |
| 5,813,234 | 9/1998 | Wighard | 62/6 |
| 5,867,991 | 2/1999 | Jalink et al. | 62/6 |

*Primary Examiner*—Henry Bennett
*Assistant Examiner*—Chen-Wen Jiang
*Attorney, Agent, or Firm*—Stephen E. Clark

[57] ABSTRACT

A standing wave pump in which a standing compression wave is produced by a pair of diametrically opposing transducers. The vibrating surfaces of the transducers are oscillated at a frequency sufficient to generate a substantially cylindrical compression wave having substantially planar wave fronts between the transducer pair. The length of pump housing is made to be equal to an integer times half the wavelength of the compression wave and the pump housing acts as a resonant cavity having a standing wave pattern set up in it. Waves are simultaneously produced and reflected by the oscillating surface and are superimposed upon one another and travel to the opposing oscillating surface where this process is repeated, substantially multiplying the intensity of the standing compression wave, which provides a stored-energy effect. The high-intensity standing compression wave has pressure nodes and antinodes, whose pressure differential is used to pump a medium through inlets and outlets advantageously located at the nodes and antinodes.

7 Claims, 10 Drawing Sheets

STANDING WAVE PUMP

BACKGROUND

1. Field of Invention

This invention relates to apparatus for compressing and conveying fluids, and with regard to certain more specific features, to apparatus which are used as compressors in compression-evaporation cooling equipment.

2. Description of Prior Art

Heretofore, nearly all refrigeration and air-conditioning compressors which have found widespread and practical application, required many moving parts. Reciprocating, rotary, and centrifugal compressors, to name a few, all have numerous moving parts. Each of these compressors will consume a portion of energy which serves only to move its parts against their frictional forces, as well as to overcome their inertia. This energy is lost in overcoming the mechanical friction and inertia of the parts, and cannot contribute to the actual work of gas compression. Therefore, the compressor's efficiency suffers. Moving parts also reduce dependability and increase the cost of operation, since they are subject to mechanical failure and fatigue. Consequently, both the failure rate and the energy consumption of a compressor tend to increase as the number of moving parts increases.

Typical refrigeration and air-conditioning compressors must use oils to reduce the friction and wear of moving parts. The presence of oils in contemporary compressors presents many disadvantages. Compressors that need oil for their operation will allow this oil to mix with the refrigerant. The circulation of this oil through the refrigeration cycle will lower the system's overall coefficient of performance, thus increasing the system's energy consumption. As such, the issue of oil-refrigerant mixtures places a restraint on ideal system design.

Another disadvantage of oil-refrigerant mixtures relates to the development of new refrigerants. Non-ozone depleting refrigerants must be developed to replace the chlorofluorcarbon (CFC) family of refrigerants. For a new refrigerant to be considered successful, it must be compatible with compressor oils. Oil compatibility is the subject of performance and toxicity tests which could add long delays to the commercial release of new refrigerants. Hence, the presence of oils in refrigeration and air-conditioning compressors reduces system efficiency and slows the development of new refrigerants.

In general, much effort has been exerted to design pumping a apparatus which lack these traditional moving parts and their associated disadvantages.

Some of these efforts have produced pumps which seek to operate on the pumped medium, using non-mechanical means. Typically these pumps operate by pressurizing the pumped medium using heat, or by exciting the pumped medium by inertia-liquid-piston effects.

Of particular interest is the inertia-liquid-piston type pump of U.S. Pat. No. 3,743,446 to Mandroian, Jul. 3, 1973, which claims to provide a pump whose pumping action is due to the properties of standing acoustical waves. Although the above patent can provide a pumping action, it does not exploit certain modes of operation which can provide greater pressure differentials and improved efficiency. As such, the Mandroian patent does not provide a practical compressor for high pressure applications, such as refrigeration and air-conditioning systems.

Another example is shown in U.S. Pat. No. 3,397,648 to Henderson, Aug. 20, 1968. Therein is disclosed a chamber in which a gas is heated and subsequently expelled through an egress check valve. As the chamber's remaining gas cools the resulting pressure differential causes more gas to be drawn into the chamber through an ingress check valve. This same method is employed in U.S. Pat. No. 3,898,017 to Mandroian, Aug. 5, 1975.

Seldom have any of the above mentioned pumping methods been applied to the field of refrigeration and air-conditioning. One such attempt is seen in U.S. Pat. No. 2,050,391 to Spencer, Aug. 11, 1936. In the Spencer patent, a chamber is provided in which a gaseous refrigerant is heated by spark discharge, and subsequently expelled through an egress check valve, due to the resulting pressure increase. As the chamber's remaining gas cools, the resulting pressure differential causes more gas to be drawn into the chamber through an ingress check valve. This approach results in ionization of the refrigerant, and could cause highly undesirable chemical reactions within the refrigeration equipment. For a practical refrigeration system, such chemical reactions would be quite unsatisfactory.

It is apparent that oil-free refrigeration and air-conditioning compressors, which require few moving parts, have not been satisfactorily developed. If such compressors were available, they could simplify the development of new refrigerants, and offer improved dependability and efficiency, thereby reducing energy consumption.

Such an oil free compressor is the subject of U.S. Pat. No. 5,020,977 to Lucas. FIG. 1 illustrates the device of Lucas which has a chamber, an input port and an output port. Forming one wall of the chamber is a transducer comprising a flexible metallic diaphragm, which has a coil attached thereto and which encircles the end of a stationary cylindrical magnet. The coil of transducer is energized through wires by a generator, which causes the coil to be driven by a periodic waveform, which in turn sets up an oscillating magnetic field about coil. Due to the alternating polarity of this oscillating field, the coil-diaphragm assembly is alternately repulsed and attracted by the cylindrical magnet and thus the diaphragm vibrates at a frequency which causes a traveling wave to be generated in the medium in the chamber. This traveling wave hits the far wall of the chamber and is reflected back out of phase with the initial wave. The chamber acts as a resonant cavity and will have a standing wave pattern set up in it. The reflected wave when it reaches the diaphragm wall is reflected coincident with the initial wave. Thus a standing wave pattern is set up in the chamber, which has pressure antinodes or displacement nodes at end wall 30 and at point 34, and pressure nodes or displacement antinodes at diaphragm 16 and at point 32.

SUMMARY OF THE INVENTION

It is an object of the present invention to provide a standing wave pump employing opposing transducers which significantly improves upon the prior art standing wave pumps and compressors;

It is a further object to provide a device of the character described wherein the opposing transducers comprise acoustically reflective and emissive actuation devices;

It is a further object to provide a device of the character described wherein the opposing acoustically reflective and emissive actuation devices comprise high-deformation piezoelectric ceramic devices;

It is a further object to provide a device of the character described wherein the opposing actuation devices are multilayer prestressed piezoelectric ceramic devices;

It is a further object to provide a device of the character described to provide an oil-less gas compressor which can develop pressure differentials large enough for refrigeration applications;

It is a further object to provide a device of the character described with optional valve arrangements by which to utilize a large portion of the peak-to-peak pressure differential of a standing acoustical wave;

It is a further object to provide a device of the character described which is a valveless acoustical compressor, by exploiting the properties of ultrasonic non-linear acoustic waves;

It is a further object to provide a device of the character described which additionally comprises a non-mechanical acoustical driver, which exploits the gaseous absorption of electromagnetic energy, thereby eliminating acoustic wave sustaining moving drive parts;

Further objects and advantages of the invention will become apparent to the reader from a consideration of the drawings and ensuing description of it.

DESCRIPTION AND OPERATION OF INVENTION

Mechanically Driven Embodiments with Valves

Figure 3:
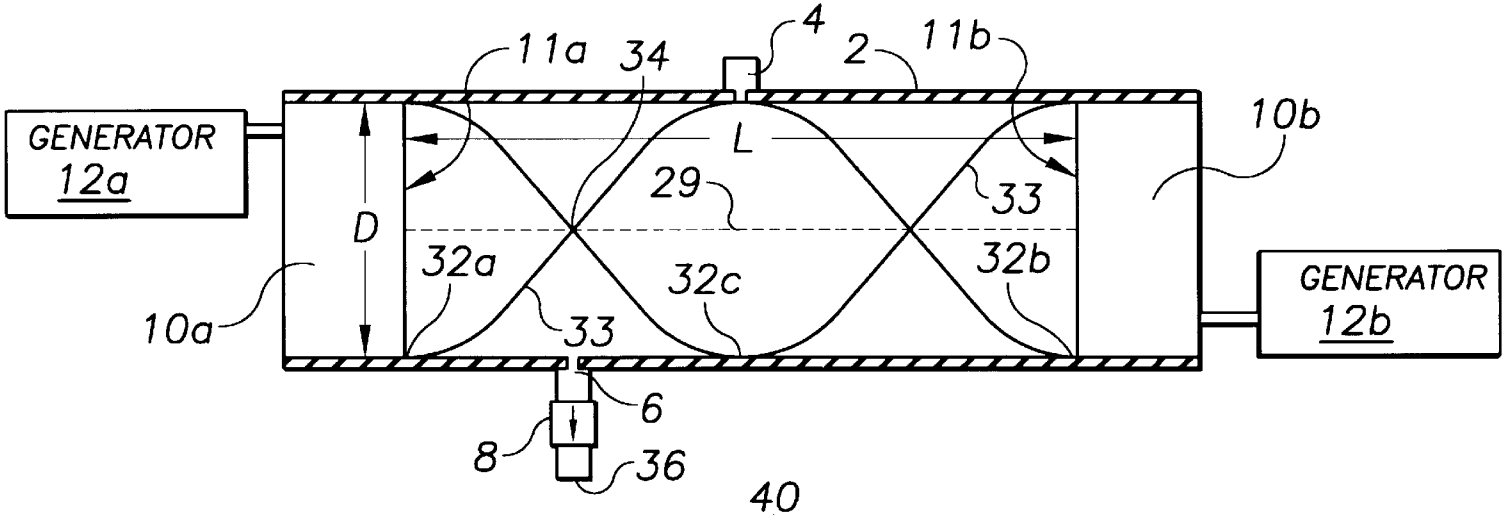
FIG. 3 shows an embodiment of the present invention which employs opposing transducers, pressure nodes and antinodes as well as input and output ports.

FIG. 3 illustrates an embodiment of the present invention. A pump housing 2 is provided which has an input port 4 and an output port 6. Output port 6 has a check valve 8 attached thereto, such that any gas/liquid (hereinafter called medium) passing through the output port 6 must also pass through check valve 8 in order to reach outlet 36. Check valve 8 allows flow out of but not into the pump housing 2.

Figure 2A:
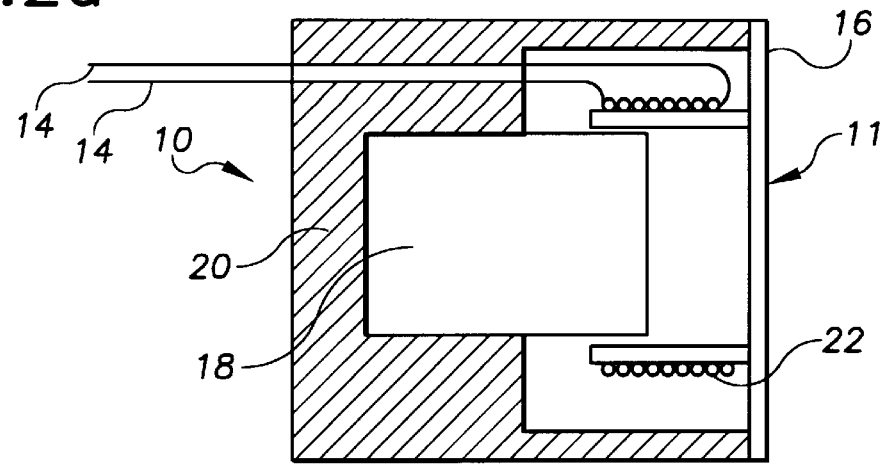
FIG. 2*a* is a view of a mechanical transducer which may be used to create the standing wave in the present invention.
Figure 2B:
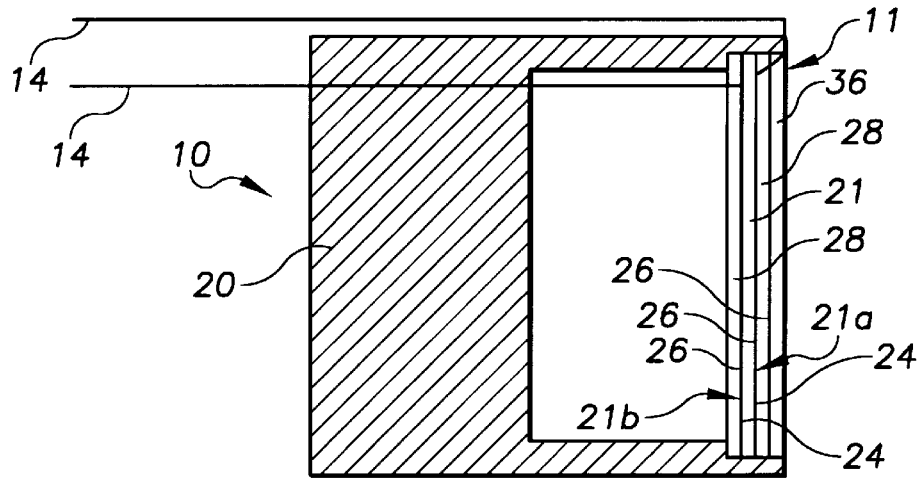
FIG. 2*b* is a view of a transducer which may be used in the present invention comprising a high deformation piezoelectric transducer as a reflective emitter.
Figure 2C:
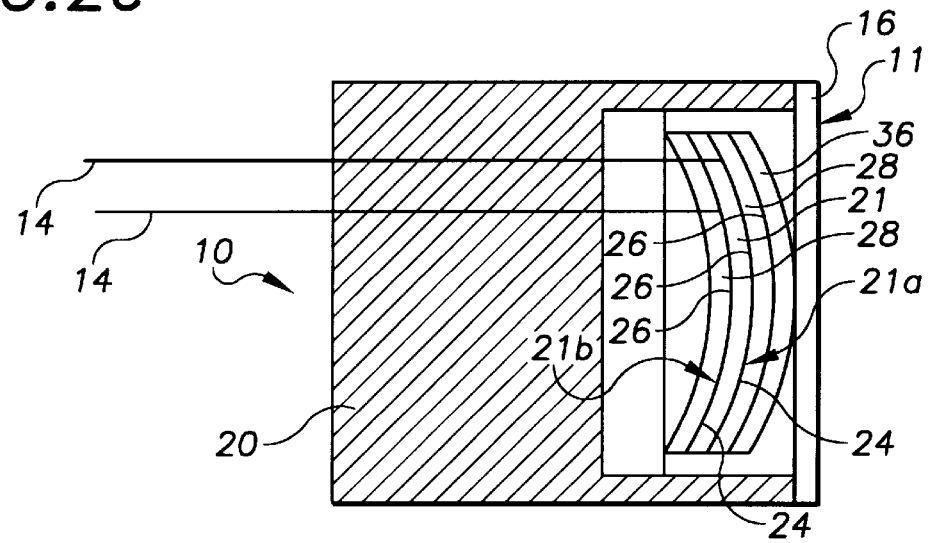
FIG. 2*c* is a view of a transducer which may be used in the present invention comprising a prestressed high deformation piezoelectric transducer as a driver for a reflective emitter.

Forming one wall 11 of the pump housing 2 is a transducer 10. FIGS. 2*a*, 2*b* and 2*c* illustrate transducers (generally referred to in the drawings as 10). The transducer of FIG. 2*a* comprises a flexible metallic diaphragm 16, which has a coil 22 attached thereto. Coil 22 encircles the end of a stationary cylindrical magnet 18. Cylindrical magnet 18 is press fitted into the body 20 of transducer 10. The coil 22 of transducer 10 is energized through wires 14 by a generator 12, such as an oscillating circuit.

In operation, the generator 12 causes the coil 22 to be driven by a periodic waveform of predetermined frequency, which in turn sets up an oscillating magnetic field about coil 22. Due to the alternating polarity of this oscillating field, the coil-diaphragm assembly is alternately repulsed and attracted by the cylindrical magnet 18. Thus, the diaphragm 16 vibrates at a predetermined frequency which causes a compression wave 33 to be generated in the medium in the chamber 2.

FIGS. 2*b* and 2*c* illustrate transducers 10 forming one wall 11 of the pump housing 2 which preferably comprises an electroactive ceramic member 21 with electrodes bonded to each of its two major faces 28 and a pre-stress layer 36 bonded to one major face. The prestress layer applies a compressive stress to the electroactive ceramic member which enables the prestressed ceramic to deform, flattening under one polarity, and bowing under the opposite polarity. The transducer 10 is energized through wires 14 connected to each electrode by a generator 12, such as an oscillating circuit. As the generator 12 applies a varying voltage to the electrodes, the transducer 10 alternately bows and flattens. This deformation may be caused by either oscillating voltage of one polarity, opposite polarities or both. In FIG. 2*b* the outer surface of the electroactive ceramic member forms the wall 11 of the transducer 10. In FIG. 2*c*, the transducer 10 preferably comprises a prestressed ceramic member in contact with and driving a diaphragm 16 which forms the wall 11 of the transducer 10. The transducers are mechanically resonant over a narrow frequency range and can be constructed to withstand high power acoustic output, and high operating pressures.

In FIGS. 2*b* and 2*c*, the transducer 10 has an initially disc-shaped electroactive element 21 which is electroplated 24 on its two major surfaces 21*a* and 21*b*. Adjacent the electroplated 24 surfaces of the electroactive element 22 are adhesive layers 26, (preferably LaRC-SI™ adhesive, as developed by NASA-Langley Research Center and commercially marketed by IMITEC, Inc. of Schenectady, N.Y.). Adjacent each adhesive layer 26 is a circular-shaped aluminum layer 28. Adjacent one aluminum layer 28 is a third adhesive layer 26 which is between the aluminum layer 28 and a circular-shaped metal prestress layer 36.

During manufacture of the transducer 10 the electroactive element 21, the adhesive layers 26, the two aluminum layers 28, and the metal prestress layer 36 are simultaneously heated to a temperature above the melting point of the adhesive material, and subsequently allowed to cool, thereby re-solidifying and setting the adhesive layers 26 and bonding them to the adjacent layers. During the cooling process the electroactive layer 21 becomes compressively stressed due to the relatively higher coefficients of thermal contraction of the materials of construction of the two aluminum layers 28 and the metal prestress layer 36 than for the material of the electroactive element 21. Also, due to the greater coefficient of thermal contraction of the combined laminate materials (an aluminum layer 28 and a metal prestress layer 36 with adhesives 26) on one side of the electroactive element 21 than the laminate materials on the other side (an aluminum layer 28 and an adhesive 26) of the electroactive element 21, the laminated structure deforms into a normally domed shape as shown in FIG. 2*c*. The ceramic element 21 and the laminate layers 28 and 36 may be initially curved such that upon cooling, the stress applied by the laminate layers (prestress layers) causes the ceramic element to flatten as shown in FIG. 2*b*.

If a relatively small voltage is applied to the two electroplated surfaces 24 of the electroactive element 21, the electroactive element 21 will piezoelectrically expand or contract in a direction perpendicular to its opposing major faces 21*a* and 21*b*, depending on the polarity of the voltage being applied. Because of the relatively greater combined tensile strength of the laminate layers bonded to one side of the electroactive element 12 than on the other, piezoelectric longitudinal expansion of the electroactive element 21 causes its radius of the curvature to become smaller. Conversely longitudinal contraction of the electroactive element 21 causes it flatten out (i.e. the radius of curvature becomes larger). Thus it will be understood that the radius of curvature of the transducer wall 11 can be slightly increased or decreased (depending on the polarity of the applied voltage) by applying a small voltage to the electroactive ceramic element 21 from a generator 12 via wires 14. The curved ceramic element 21 of FIG. 2*c* is in contact with a flat diaphragm 16 which forms the wall 11 of the transducer 10. Alternatively, the outer surface of the flat prestressed ceramic element 21 of FIG. 2*b* may act as a diaphragm forming the wall 11 of the transducer.

Referring to FIG. 3, in operation, the generator 12*a* causes transducer 10*a* to be driven by a periodic waveform of predetermined frequency. The first transducer 10*a* preferably comprises a prestressed ceramic member in contact with and driving a diaphragm 16 which forms the wall 11*a* of the transducer 10*a*. The first transducer 10*a* vibrates at a predetermined frequency which causes the diaphragm 16 to vibrate and a compression wave 33 to be generated in the medium in the pump housing 2. When this compression wave 33 hits the other wall 11*b* of pump housing 2, it is reflected back in phase with the initial wave. Forming the second wall 11*b* of the pump housing 2 is the diaphragm of a second transducer 10*b* which also preferably comprises a prestressed ceramic member in contact with and driving a diaphragm 16 which forms the wall 11*a* of the transducer 10*a*.

The generator 12*b* also causes transducer 10*b* to be driven by a periodic waveform of predetermined frequency. Thus, the wall 11*b* of the second transducer 10*b* vibrates at a predetermined frequency which also causes a compression wave 33 to be generated in the medium in the pump housing 2. When this compression wave 33 hits the other wall 11*a* of pump housing 2, it is also reflected back in phase with the initial compression wave 33.

FIG. 3 shows an embodiment of the invention in which a standing compression wave 33 is produced by a pair of diametrically opposing transducers 10*a* and 10*b*. Each transducer (10*a* and 10*b*) preferably comprises a flat circular vibrating surface (11*a* and 11*b*) which is located at one end of the pump housing 2. In this embodiment of the invention, each transducer of a transducer pair (10*a* and 10*b*) produces waves of identical frequency and amplitude in the pump housing 2. In this embodiment of the invention, opposing pairs of circular vibrating surfaces 11*a* and 11*b* are of equal diameter D.

In order to establish a standing wave between opposing transducers (or more particularly, between opposing vibrating surfaces 11*a* and 11*b*), the distance L1 between facing vibrating surfaces 11*a* and 11*b* must be an integer number of half wavelengths such that there occurs an antinode (32*a* and 32*b*) of the standing compression wave 33 at each of the vibrating surfaces 11*a* and 11*b*.

In this embodiment of the invention the vibrating surfaces 11*a* and 11*b* are oscillated at a frequency sufficient to generate a substantially cylindrical compression wave having substantially planar wave fronts, the axis of which cylinder corresponds to the longitudinal axis 29 between the corresponding transducer pair 10*a* and 10*b*. In order to generate a substantially cylindrical planar standing compression wave 33, the wavelength lambda of the wave being generated should be substantially smaller than the diameter D of the vibrating surfaces 11*a* and 11*b*. In this embodiment of the invention, in order to generate cylindrical planar compression waves of high resolution, the diameter D of the vibrating surfaces 11*a* and 11*b* is at least four times as great as the wavelength lambda of the standing compression wave 33 produced by the oscillation of the vibrating surfaces 11*a* and 11*b*.

The wave produced by the opposing transducers 10*a* and 10*b* is a standing compression (longitudinal) wave 33, resulting from the superposition of two similar plane waves of identical frequency and amplitude, traveling in opposite directions. Because the diameter D of the vibrating surfaces 11*a* and 11*b* is large relative to the wavelength lambda of the wave produced, the oscillations generate an ultrasonic "beam" that is unidirectional with substantially planar wave fronts; but the lateral extent (e.g. corresponding to the diameter of cylinder) of the "beam" remains substantially the same as the diameter of the vibrating surfaces 11*a* and 11*b*. Each wave produced by the oscillations of vibrating surface 11*a* extends from one end of the pump housing 2 to the opposite end of the pump housing 2, and is thereby reflected by the opposing vibrating surface 11*b*, and vice versa. When the wave produced by vibrating surface 11*a* hits the vibrating surface 11*b*, it is reflected back in phase with the initial wave. If the length of pump housing 2 is made to be equal to an integer times the wavelength of the traveling wave in the medium divided by two then the pump housing 2 will act as a resonant cavity and will have a standing wave pattern set up in it.

It should be understood that as vibrating surface 11*b* reflects the wave produced by vibrating surface 11*a* it is coincidentally oscillating and producing a wave which is in phase with the initial wave. Thus, the wave reflected by oscillating surface 11*b* and the wave produced by oscillating surface 11*b* are superimposed upon one another and travel to oscillating surface 11*a* where this process is repeated. This ongoing reinforcement is repeated at each vibrating surface (11*a* and 11*b*) thus substantially multiplying the intensity of the standing compression wave 33, which provides a stored-energy effect. Since this effect reduces the amount of input energy needed from the transducer and its driver, the pump's efficiency is improved. Thus a high-intensity standing compression wave is set up in the pump housing 2.

Figure 1:
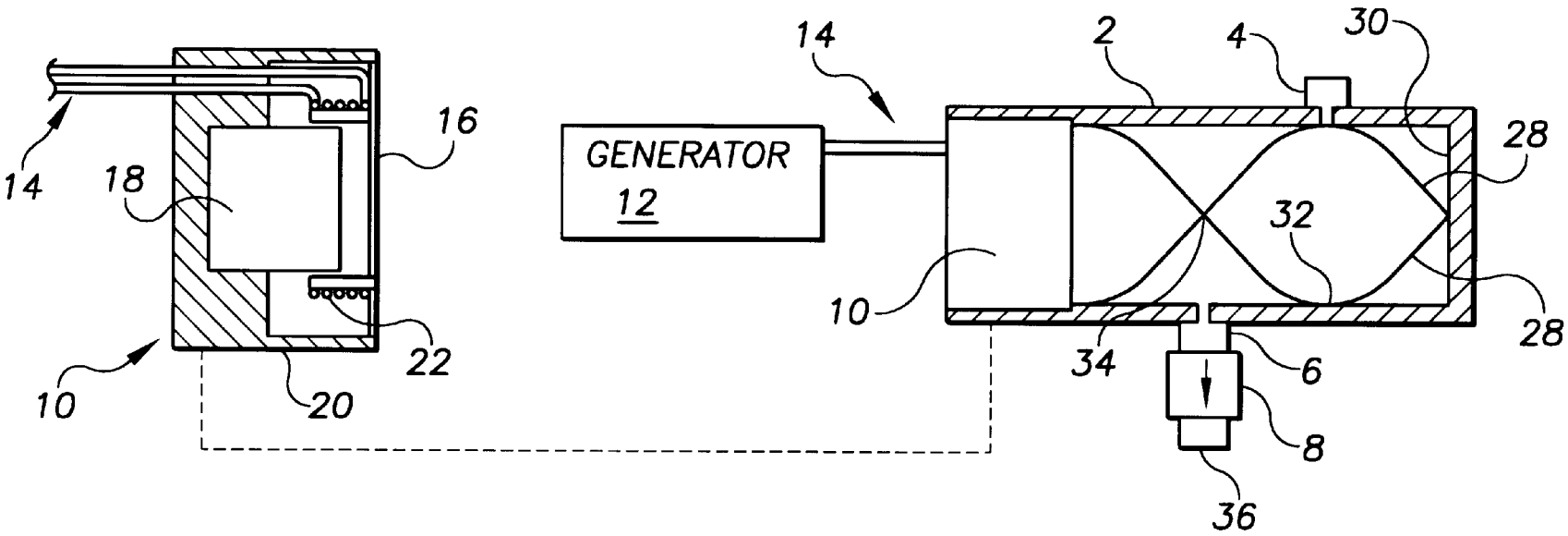
FIG. 1 PRIOR ART
FIG. 1 is a partly schematic, partly sectional view of a mechanically driven embodiment of the prior art.

The embodiment shown in FIG. 3 operates in substantially the same manner and according to the same theory and principles as the embodiment described above with reference to FIG. 1. However, due to the increased intensity of the standing wave in the embodiment shown in FIG. 3 as compared to the standing wave in the embodiment shown in FIG. 1, the embodiment shown in FIG. 3 can produce much higher pressure differentials than an embodiment only employing one transducer, thereby improving efficiency and overall pumping capabilities.

To illustrate the increased efficiency, for an initial wave created with energy amplitude A, the reflected wave may lose half of its energy upon reflection from the opposite wall, thus having a reflected energy amplitude of A/2. Losses due to attenuation of the wave in the medium are negligible in comparison to reflective losses. In the prior art standing wave compressor, a travelling wave 26 is created with energy amplitude A, and the reflected wave 28 loses half of its energy on reflection, thus having a reflected energy amplitude of A/2. The reflected wave 28 is not reinforced as it reflects from the first wall. The reflected wave 28 is first reinforced upon its second reflection from the original transducer 10. The reflected wave 28 now with energy amplitude A/2 again loses half of its energy amplitude when reflected from the transducer wall, which is superimposed with the coincident wave with energy amplitude A, resulting in a reinforced travelling wave 26 with energy amplitude 5 A/4 or 1.25 A.

The present invention, by using opposed transducers, reinforces the energy amplitude at each transducer wall, minimizing reflective losses by reinforcing the reflected waves twice as often. In the present invention a compression wave 33 is created with energy amplitude A, and the reflected wave loses half of its energy on reflection, thus having a reflected energy amplitude of A/2. The reflected compression wave, however is reinforced as it reflects from the wall 11*b* of the second transducer 10*b* which generates a coincident compression wave 33 with energy amplitude A in phase with the reflected wave. The resultant reflected wave has an energy amplitude of 3 A/2 or 1.5 A. The reflected wave is also reinforced upon its second reflection from the wall 11*a* of the first transducer 10*a*. The reflected compression wave now with energy amplitude 3 A/2 loses half of its energy amplitude when reflected, which is superimposed with the coincident compression wave 33 of the first transducer with energy amplitude A, resulting in a reinforced compression wave 33 with energy amplitude 7 A/4 or 1.75 A.

Thus, the present invention will generate opposing compression waves coincident with the waves reflected at each transducer wall 11*a* and 11*b,* wherein the compression wave 33 reflected from the first transducer 10*a* is reinforced twice and can have energy amplitudes 25 to 30 percent higher than the prior art single transducer compressor.

Figure 4:
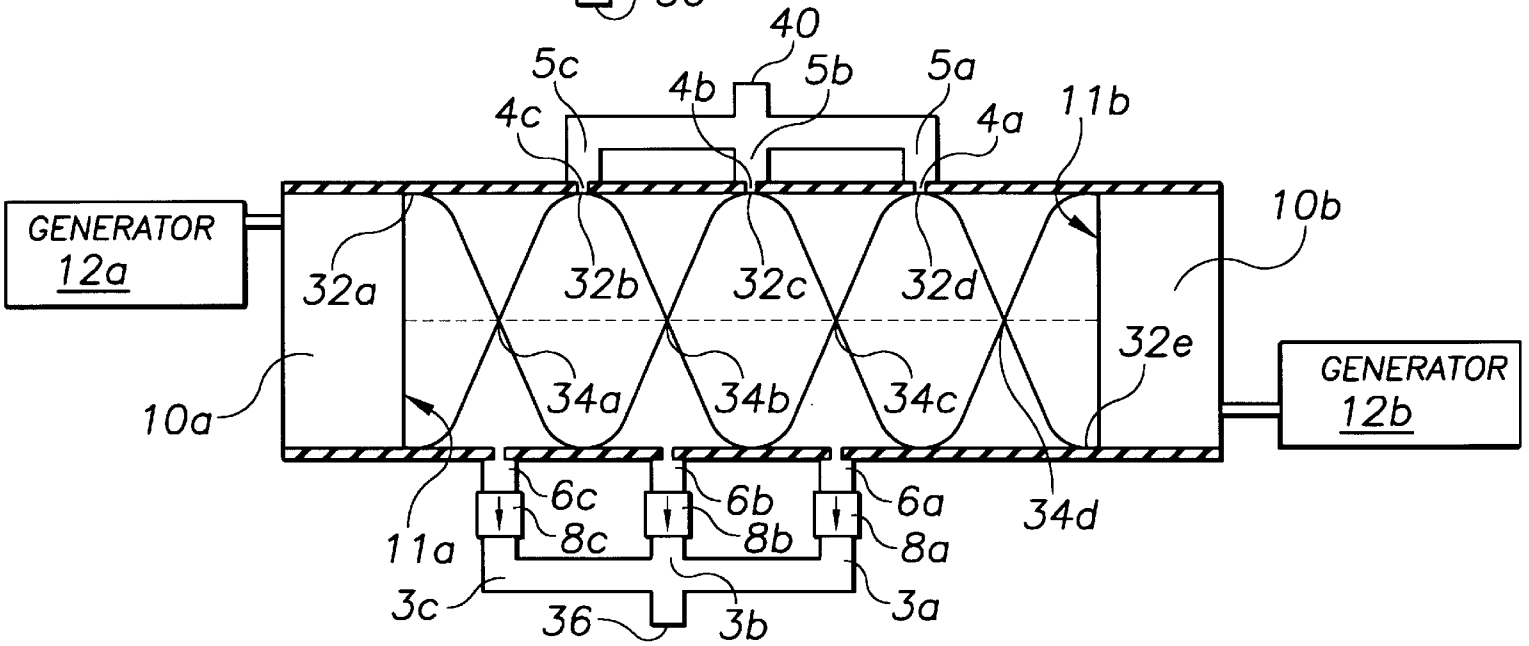
FIG. 4 shows an embodiment functionally the same as FIG. 3, but provides additional pressure nodes and antinodes as well as additional inlet and outlet ports.

As illustrated in FIG. 4, a standing wave pattern is set up in the pump housing 2, which has pressure antinodes or displacement nodes at points 34*a*, 34*b*, 34*c* and 34*d*, and pressure nodes or displacement antinodes at the first and second transducer walls 11*a* and 11*b* (points 32*a* and 32*e*) and at points 32*b*, 32*c* and 32*d*. As each wave reflects off of a transducer wall, it is coincident with the initial wave formed at that wall. Thus the transducer walls act as reflectors and emitters simultaneously. The energy stored in the compression waves 33 is reinforced with each simultaneous reflection and emission and can achieve energies several times greater than energy of waves produced by either transducer alone.

In FIG. 3, the placement of input port 4 and output port 6 is as follows. Output port 6 is located at pressure antinode 34. The pressure at pressure antinode 34 oscillates above and below the undisturbed pressure of the medium. Also, if the amplitude of these oscillations is large enough, the average pressure at the pressure antinode can rise above the undisturbed pressure of the medium. Input port 4 is located at pressure node 32*c*. The minimum pressure existing at pressure node 32*c* is less than the undisturbed pressure of the medium. Check valve 8 provides a rectification of the oscillating pressure at pressure antinode 34. When the pressure at antinode 34 reaches a predetermined value, which is higher than the undisturbed pressure of the medium, check valve 8 opens. Thus some of the medium is allowed to flow out of the pump housing 2 by passing in turn through output port 6, check valve 8, and then into outlet 36. When the pressure at antinode 34 drops below the predetermined value, check valve 8 closes and prevents the medium from flowing back into pump housing 2.

In this way the quantity of medium in pump housing 2 is continually reduced, and the pressure at node 32*c* drops even lower than its normal minimum value, which in turn causes additional medium to be drawn through input port 4 into pump housing 2. Thus, when the medium in pump housing 2 is excited by the action of transducers 10*a* and 10*b* and a standing wave pattern is set up therein consisting of pressure nodes and antinodes, some of the medium inside pump housing 2 at antinode 34 will be periodically forced out of pump housing 2, due in part to check valve's 8 rectification of the oscillating pressure at output port 6. In addition, the medium immediately outside pump housing 2 at input port 4 will be drawn into pump housing 2. In this way, the embodiment of FIG. 3 produces a pressure differential between input port 4 and outlet 36. This pressure differential will be roughly equal to the difference between the peak pressure at antinode 34 and the minimum pressure at node 32*c*.

It should be noted that none of the embodiments of the present invention are limited to a pump housing of only one length. Accordingly, for a given wavelength lambda, the length of pump housing 2 in FIG. 3 can be any length which equals n lambda/2, and therefore the pump housing 2 is not limited to the length 2 lambda/2. In short, there are any number of possible pump housings 2 with lengths that are integer multiples of lambda/2.

FIG. 4 shows an embodiment of the invention which provides a pump housing 2 having multiple input ports 4*a*, 4*b*, 4*c* and multiple output ports 6*a*, 6*b*, 6*c*. Inlet 40 has input ports 4*a*, 4*b*, 4*c* all attached thereto by respective conduits 5*a*, 5*b*, 5*c*, such that any medium passing from input ports 4*a*, 4*b*, 4*c* into pump housing 2, must first pass through inlet 40. Output ports 6*a*, 6*b*, 6*c* have check valves 8*a*, 8*b*, 8*c* attached respectively thereto, and said checkvalves are attached to outlet 36 by respective conduits 3*a*, 3*b*, 3*c*, such that any medium passing through the output ports 6*a*, 6*b*, 6*c* must also pass through respective checkvalves 8*a*, 8*b*, 8*c* in order to reach outlet 36. Check valves 8*a*, 8*b*, 8*c* allow flow out of but not into the pump housing 2. Forming one wall of the pump housing 2 is a first transducer element 10*a,* said element being the same in form and function as the transducer element 10 of FIGS. 2*a*–2*c*. Transducer 10*a* is energized by a generator 12*a*, such as an oscillating circuit.

The embodiment of FIG. 4 operates in exactly the same manner and according to the same theory and principles as the embodiment of FIG. 3. This can be seen by realizing that the acoustic processes which occur between the single input port 4 and checkvalve 8 of FIG. 3, can also occur between multiple input ports 4*a*, 4*b*, 4*c* and multiple checkvalves 8*a*, 8*b*, 8*c* of FIG. 4. The number of input ports in FIG. 4 could be reduced to one if so desired.

Figure 5:
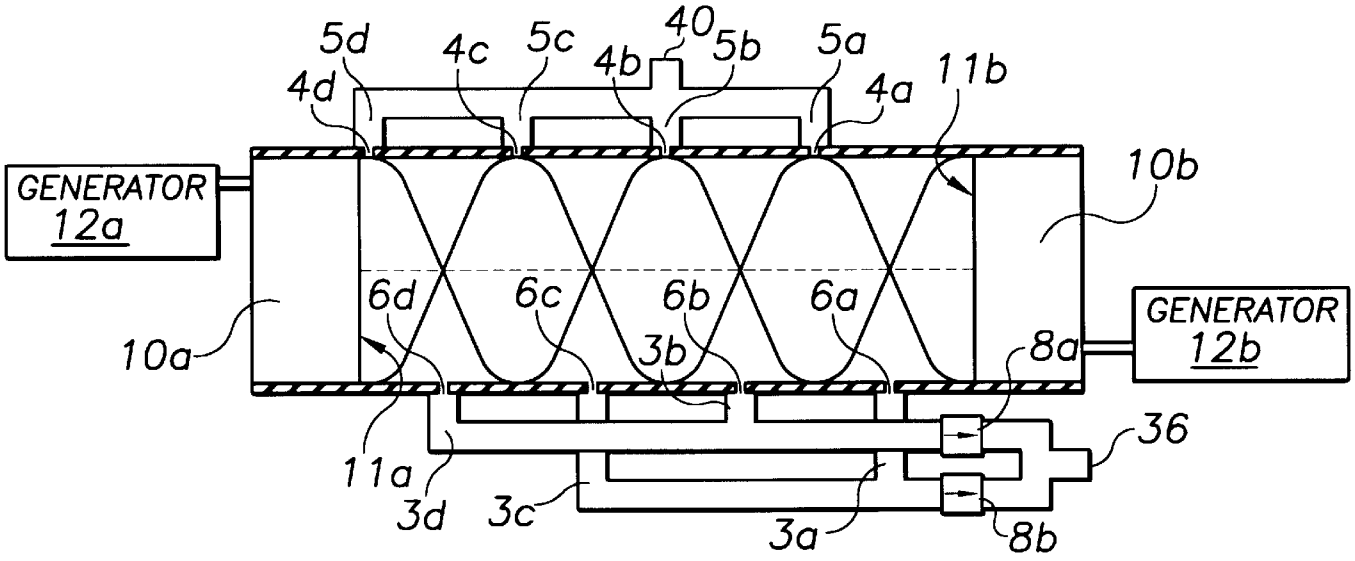
FIG. 5 shows an embodiment that reduces the total number of output check valves needed for a full-wave discharge cycle to a maximum of two.

In FIG. 5 an embodiment of the invention is shown, which limits the number of output check valves needed to two, regardless of the number of output ports. In general, each consecutive pressure antinode is 180° out of pressure-phase with its neighboring pressure antinodes. If antinode n has pressure+P, then antinode n+1 has pressure−P, and antinode n+2 has pressure+P, and so on. In other words, if at a certain time "t" a given antinode's pressure is high, then at that same instant its neighboring antinode's pressure will be low, and the next will be high, and so on. Consequently, since only two pressure-phases exist, all output ports of one phase can be routed through one check valve, and all output ports of the other phase can be routed through another check valve.

FIG. 5 shows inlet 40 with input ports 4*a*, 4*b*, 4*c*, 4*d* all attached thereto by respective conduits 5*a*, 5*b*, 5*c*, 5*d* such that any medium passing from input ports 4*a*, 4*b*, 4*c*, 4*d* into pump housing 2, must first pass through inlet 40. Output ports 6*a* and 6*c* are attached by respective conduits 3*a* and 3*c* to check valve 8*b*, such that any medium passing through output ports 6*a* and 6*c* must also pass through check valve 8*b* in order to reach outlet 36. Output ports 6*b* and 6*d* are attached by respective conduits 3*b* and 3*d* to check valve 8*a*, such that any medium passing through output ports 6*b* and 6*d* must also pass through check valve 8*a* in order to reach outlet 36.

This arrangement can be extended to any number of output ports, such that two check valves will be sufficient regardless of the number of output ports, as long as the two groups of like-pressure-phase output ports are routed through their two respective check valves. This matching of like-pressure-phase output ports is necessary, because if two or more output ports of unlike-pressure-phase were connected together, the medium would tend to flow back and forth between the alternating high and low pressure output ports. Thus, the medium would be allowed to shunt the output check valve and reenter the pump housing, so that no pumping would occur. With the exception of this new output check valve arrangement, the embodiment of FIG. 5 operates in the same manner and according to the same theory and principles as the embodiment of FIG. 4. The number of input ports in FIG. 5 could be reduced to one if so desired.

Figure 6:
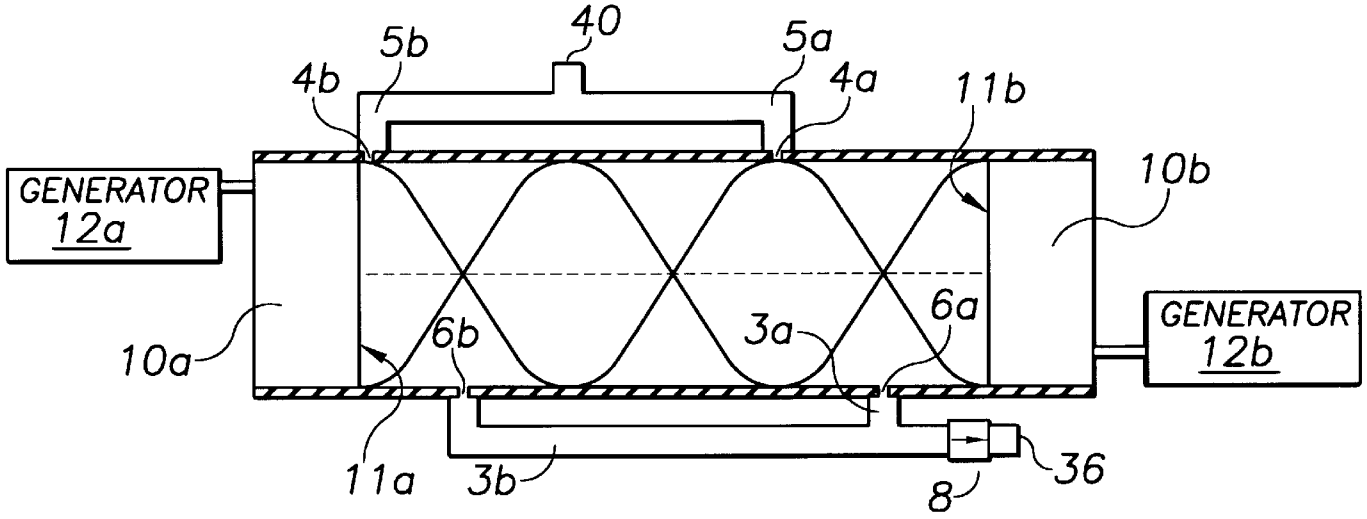
FIG. 6 shows an embodiment of the invention which limits the number of output check valves needed for a half-wave discharge cycle to one.

In FIG. 6 an embodiment of the invention is shown, which limits the number of output check valves needed to one, regardless of the number of output ports. Inlet 40 has input ports 4*a* and 4*b* attached thereto by respective conduits 5*a* and 5*b* such that any medium passing from input ports 4*a* and 4*b* into pump housing 2, must first pass through inlet 40. Output ports 6*a* and 6*b* are attached by respective conduits 3*a* and 3*b* to check valve 8, such that any medium passing through output ports 6*a* and 6*b* must also pass through check valve 8 in order to reach outlet 36. This grouping of output ports through a single check valve, is again due to the matching of like-pressure-phase antinodes. This arrangement can be extended to any number of output ports, such that one check valve will be sufficient regardless of the number of output ports, as long as like-pressure-phase output ports are routed through a single check valve. With the exception of this new output check valve arrangement, the embodiment of FIG. 6 a operates in the same manner and according to the same theory and principles as the embodiment of FIG. 4. The number of input ports in FIG. 6 could be reduced to one if so desired.

The embodiments of FIG. 4 and FIG. 5 will discharge the medium twice in one period of the standing wave. This full-wave pumping is due to the fact that the output ports are connected to pressure antinodes of both pressure phases. The embodiments of FIG. 6 will discharge the medium once in one period of the standing wave. This half-wave pumping is due to the fact that the output ports are connected to pressure antinodes of only one pressure phase.

Figure 7:
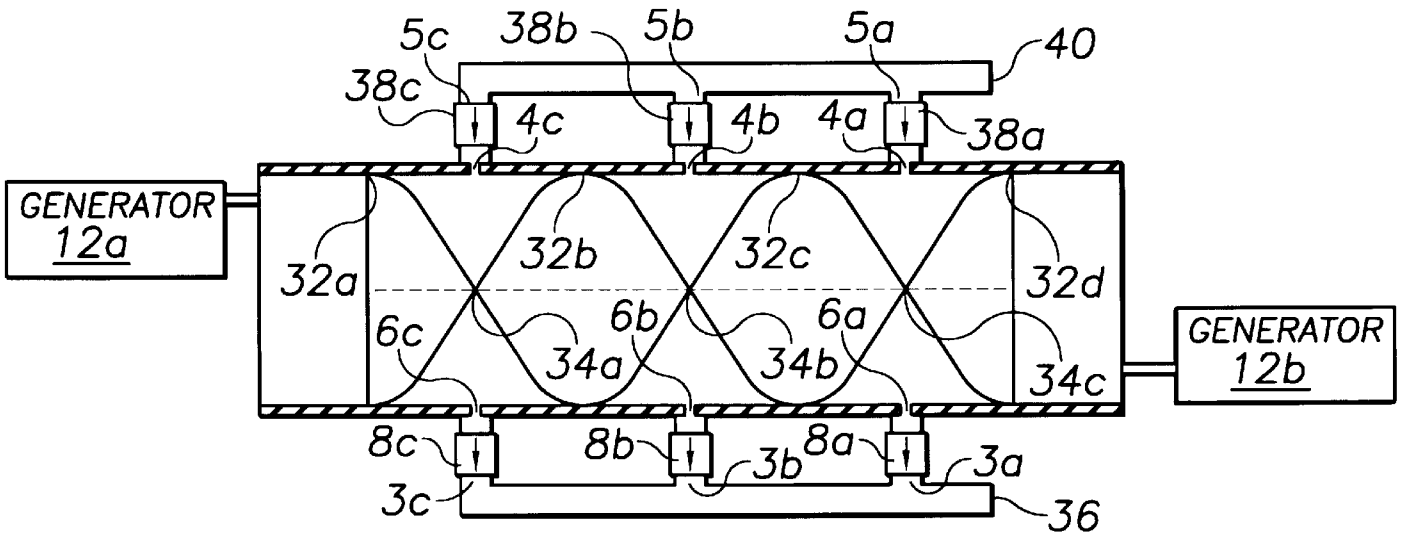
FIG. 7 shows an embodiment of the invention, which locates both input and output ports at the pressure antinodes.

FIG. 7 shows an embodiment of the invention which has a new input port arrangement. A pump housing 2 has multiple input ports 4*a*, 4*b*, 4*c* and multiple output ports 6*a*, 6*b*, 6*c*. Output ports 6*a*, 6*b*, 6*c* have check valves 8*a*, 8*b*, 8*c* attached respectively thereto, and said check valves are attached by respective conduits 3*a*, 3*b*, 3*c* to outlet 36, such that any medium passing through the output ports 6*a*, 6*b*, 6*c* must also pass through respective check valves 8*a*, 8*b*, 8*c* in order to reach outlet 36. Input ports 4*a*, 4*b*, 4*c* have check valves 38*a*, 38*b*, 38*c* attached respectively thereto, and said checkvalves are attached by respective conduits 5*a*, 5*b*, 5*c* to inlet 40, such that any medium passing into inlet 40, must first pass through respective check valves 38*a*, 38*b*, 38*c* in order to reach respective input ports 4*a*, 4*b*, 4*c*. Check valves 38*a*, 38*b*, 38*c* allow flow into but not out of the pump housing 2. Check valves 8*a*, 8*b*, 8*c* allow flow out of but not into the pump housing 2. Forming the walls of the pump housing 2 are opposed transducers 10*a* and 10*b*, said transducers being the same in form and function as the transducer elements 10 of FIGS. 2*a*–2*c*, with transducer 10 energized by a generator 12, such as an oscillating circuit.

In operation, transducers 10*a* and 10*b* maintain a standing wave of given wavelength "lambda" in the pump housing 2, resulting in multiple pressure nodes 32*a*, 32*b*, 32*c*, 32*d* and antinodes 34*a*, 34*b*, 34*c*. Input ports 4*a*, 4*b*, 4*c* and output ports 6*a*, 6*b*, 6*c* are all coincident with respective pressure antinodes 34*a*, 34*b*, 34*c*. When the pressure at any one of the antinodes 34*a*, 34*b*, 34*c* reaches a predetermined value, which is higher than the undisturbed pressure of the medium, its corresponding input check valve closes, and its corresponding output check valve opens. Hence, when the pressure of a antinode goes high, the medium is prevented from leaving the pump housing 2 through that antinode's input port, but is allowed to flow out of the pump housing 2 by passing through that antinode's output port, then through its output checkvalve, and then through outlet 36.

When the pressure at any one of the antinodes 34*a*, 34*b*, 34*c* drops below a predetermined value, which is lower than the undisturbed pressure of the medium, its corresponding input check valve opens, and its corresponding output check valve closes. Hence, when the pressure of a antinode goes low, the medium is prevented from reentering the pump housing 2 through that antinode's output port, but is allowed to flow into the pump housing 2 by passing first through inlet 40, then through the antinode's input check valve, and then through its input port into pump housing 2.

Thus, when the medium in pump housing 2 is excited by the action of transducers 10*a* and 10*b*, a standing wave pattern is set up therein consisting of pressure nodes and antinodes. As a result, the medium at the pressure antinodes 34*a*, 34*b*, 34*c* will be periodically forced out of pump housing 2 due to check valve's 8*a*, 8*b*, 8*c* rectification of the oscillating pressure at the output ports 6*a*, 6*b*, 6*c*. In addition, the medium immediately outside pump housing 2 at inlet 40 will be periodically drawn into pump housing 2 due to check valve's 38*a*, 38*b*, 38*c* rectification of the oscillating pressure at the input ports 4*a*, 4*b*, 4*c*. In this way, the embodiment of FIG. 7 produces a pressure differential between inlet 40 and outlet 36. The number of input and output ports in FIG. 6 could be reduced to one each, or extended to many more.

Figure 8:
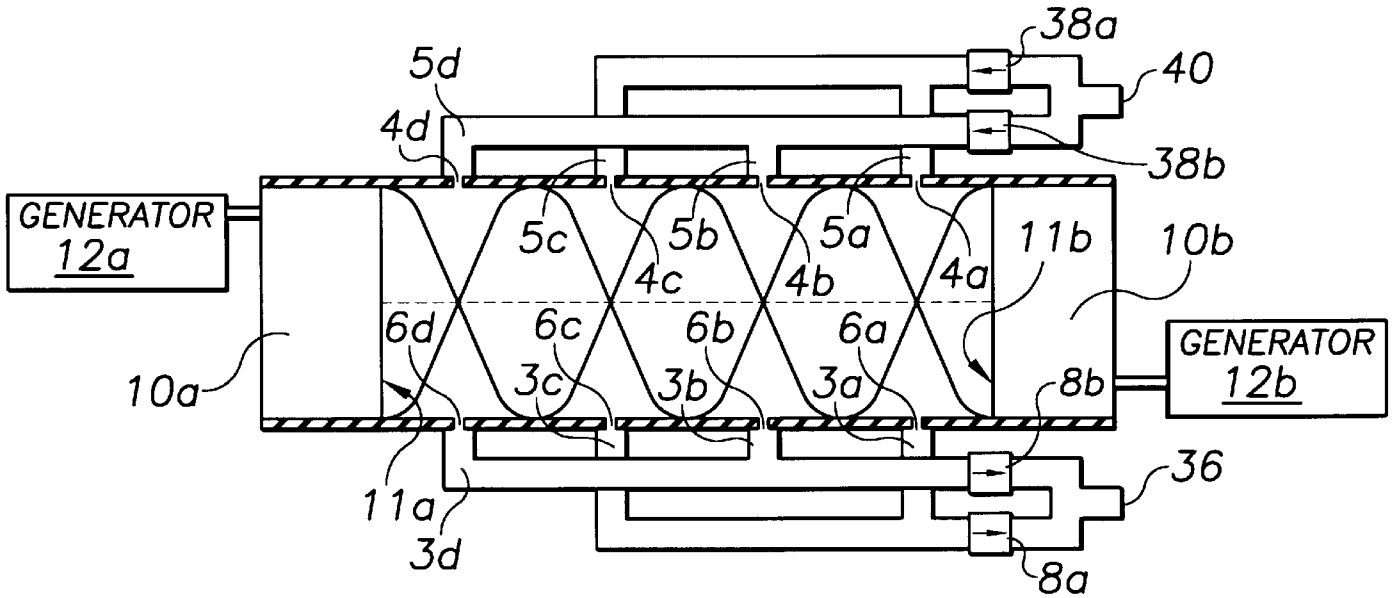
FIG. 8 shows an embodiment that reduces the total number of input and output check valves needed for a full-wave suction and discharge cycle to a maximum of four.

In FIG. 8 an embodiment of the invention is shown which limits the number of input check valves needed to two, and the number of output check valves needed to two, regardless of the number of input and output ports. FIG. 8 shows output ports 6*a* and 6*c* attached by respective conduits 3*a* and 3*c* to check valve 8*b*, such that any medium passing through output ports 6*a* and 6*c* must also pass through check valve 8*b* in order to reach outlet 36. Output ports 6*b* and 6*d* are attached by respective conduits 3*b* and 3*d* to check valve 8*a*, such that any medium passing through output ports 6*b* and 6*d* must also pass through check valve 8*a* in order to reach outlet 36. Input ports 4*a* and 4*c* are attached by respective conduits 5*a* and 5*c* to check valve 38*a*, such that any medium passing through inlet 40, must pass first through check valve 38*a* in order to reach input ports 4*a* and 4*c*. Input ports 4*b* and 4*d* are attached by respective conduits 5*b* and 5*d* to check valve 38*b*, such that any medium passing through inlet 40, must pass first through check valve 38*b* in order to reach input ports 4*b* and 4*d*.

This grouping of input and output ports with their respective check valves, is again due to the matching of like-pressure-phase antinodes. This arrangement can be extended to any number of input and output ports, such that only two input check valves and two output check valves will be sufficient regardless of the number of input and output ports, as long as the two groups of like-pressure-phase output ports and the two groups of like-pressure-phase input ports are routed through their four respective check valves. With the exception of this new input and output check valve arrangement, the embodiment of FIG. 8 operates in the same manner and according to the same theory and principles as the embodiment of FIG. 7.

Figure 9:
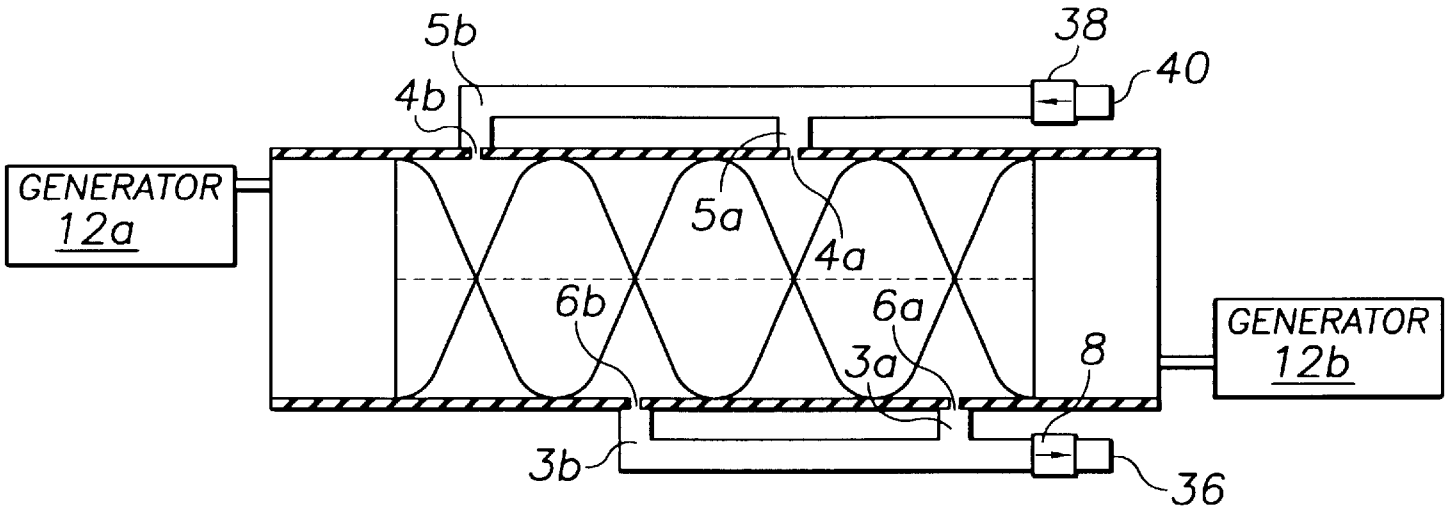
FIG. 9 shows an embodiment that reduces the total number of input and output check valves needed for a half-wave suction and discharge cycle to a maximum of two.

In FIG. 9 an embodiment of the invention is shown which limits the number of input check valves needed to one, and number of output check valves needed to one, regardless of the number of input and output ports. FIG. 9 shows output ports 6*a* and 6*b* attached by respective conduits 3*a* and 3*b* to check valve 8, such that any medium passing through output ports 6*a* and 6*b* must also pass through check valve 8 in order to reach outlet 36. Input ports 4*a* and 4*b* are attached by respective conduits 5*a* and 5*b* to check valve 38, such that any medium passing through inlet 40, must pass first through check valve 38 in order to reach input ports 4*a* and 4*b*. This grouping of input and output ports with their respective check valves, is again due to the matching of like-pressure-phase antinodes.

In FIG. 9, the input and output ports are located at different like-pressure-phase antinodes, but the input and output ports could also be located at the same like-pressure-phase antinodes. This arrangement can be extended to any number of input and output ports, such that one input check valve and one output check valve will be sufficient regardless of the number of input and output ports, as long as the like-pressure-phase output ports and the like-pressure-phase input ports are routed through their two respective check-valves. With the exception of this new input and output check valve arrangement, the embodiment of FIG. 9 operates in the same manner and according to the same theory and principles as the embodiment of FIG. 7.

The embodiments of FIG. 7 and FIG. 8 will draw in medium twice during one period of the standing wave, and will also discharge the medium twice in one period of the standing wave. This full-wave pumping is due to the fact that the input and output ports are connected to pressure antinodes of both pressure phases. The embodiment of FIG. 8 will draw in medium once during one period of the standing wave, and will also discharge the medium once in one period of the standing wave. This half-wave pumping is due to the fact that the input ports are connected to pressure antinodes of only one pressure phase and the output ports are connected to pressure antinodes of only one pressure phase.

Many different transducer types can be used in each of the above mechanically driven embodiments. As such, the use of transducer 10 is not intended as a limitation on the invention. Ultrasonic drivers are available which can produce very high pressure acoustic waves. For example, piezoelectric transducers (preferably a multi-layered, prestressed, high deformation piezoelectric transducer)—may be advantageously used to produce the vibrations necessary for creation of the standing compression wave 33.

Figure 10:
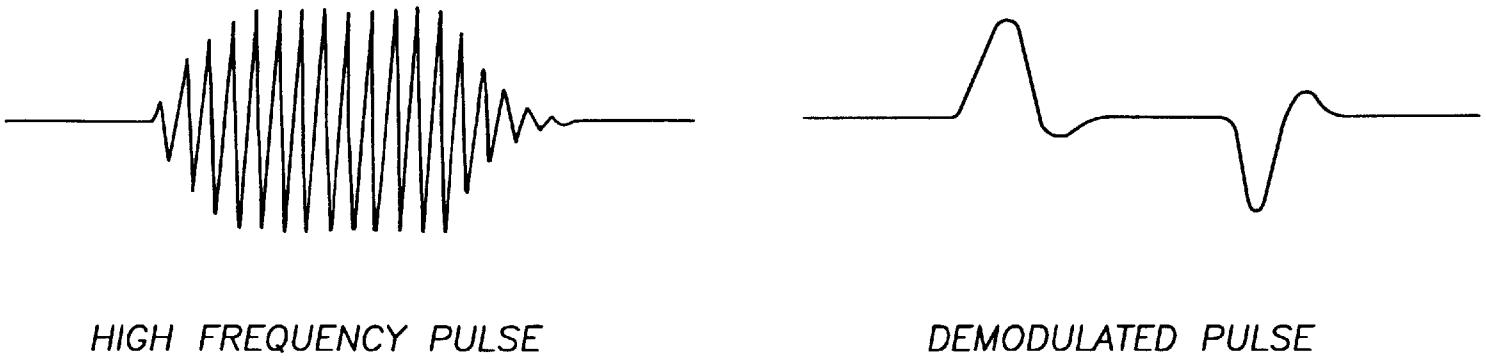
FIG. 10 is an amplitude vs. time plot, which illustrates the demodulation of high frequency ultrasonic energy into lower frequency pulses.

An ultrasonic driver can also be used in a nonresonant pulsed or modulated mode. By "nonresonant mode," it is meant that the frequency of the driver is not equal to the frequency of the standing acoustical wave. In the pulsed mode, the ultrasonic driver will operate at a frequency which is much higher than the frequency of the standing acoustic wave. The driver is switched rapidly off and on to create a succession of short pulses; each pulse consisting of a short train of high frequency oscillations. FIG. 10 shows the acoustic waveform of a single "high frequency pulse," just after it leaves the driver. After traversing a short distance through the medium, the "high frequency pulse" evolves into the "demodulated pulse." This demodulation occurs when the high frequency acoustic waves are absorbed, leaving only pulses behind. The desired mode of the standing acoustic wave can be excited by the demodulated pulses. One or more ultrasonic drivers could be placed in contact with the gas at one or more pressure antinodes. This placement would allow energy to be added to the standing acoustic wave at more than one location.

In the modulated mode, the output of the ultrasonic driver would be modulated by a lower frequency waveform. Thus a standing acoustical wave could be excited whose frequency would be equal to the modulating frequency, since one positive demodulated pulse is produced per period of the modulating waveform.

The advantage of using these nonresonant driving modes, is that ultrasonic drivers can produce efficient high power acoustical outputs at high frequencies. Thus, the nonresonant driving method provides a way in which these high power sources can be used to drive lower frequency acoustic modes.

Mechanically Driven Embodiments Without Valves

It has long been known, that a standing acoustical wave in a pump housing can produce a discernible pressure differential between nodes and antinodes, without the use of valves. Kundt's tube, which uses this effect to measure acoustic wavelengths, has been used since the early 19th century. However, this valveless arrangement would not appear to be a candidate as a refrigeration compressor. To be considered as a gas compressor in general, a device must efficiently produce high pressure differentials.

By operating the present invention in its ultrasonic nonlinear mode, valveless operation is made practical. The following advantages are realized by operating the present invention in its ultrasonic nonlinear mode:

1. Nonlinear effects or "higher ordered" effects, can usually be ignored for small amplitude acoustic waves. However, at large amplitudes these nonlinear effects become much more significant.

As mentioned previously, it is an empirical fact that the pressure nodes can be points of minimum pressure in a standing acoustic wave. What is not apparent, is that this minimum pressure which can exist at the pressure nodes is a nonlinear effect. As such, the magnitude of this minimum pressure, relative to the peak acoustic pressure, becomes increasingly large at higher acoustic pressures.

2. At the pressure antinodes, the pressure is oscillating above and below the undisturbed pressure of the gas. For small amplitude waves, the acoustic behavior of the gas is nearly linear, and the pressure oscillations above and below the undisturbed pressure of the gas are approximately equal. As such, the time average pressure at the pressure antinodes would be equal to the undisturbed pressure of the gas. However, in the nonlinear region, these pressure oscillations above and below the undisturbed pressure of the gas, can become increasingly unequal. Consequently, the average pressure at the pressure antinodes can rise above the undisturbed pressure of the gas. The magnitude of this pressure increase, relative to the peak acoustic pressure, becomes increasingly large at higher acoustic pressures.

One contribution to this effect pertains to the formation of shock waves. The presence of large amplitude acoustic waves will lead to shock wave formation. These shock waves can produce large increases in the density and pressure of the gas. Such increases can be many times higher than would be expected from strictly linear considerations.

Another contribution to this effect can be seen by considering what happens when these large amplitude pressure waves are formed. In such a case the acoustic wave's peak pressure can become large when compared to the undisturbed gas pressure. For example, if an acoustic wave having a peak pressure of 5 atmospheres is driven into a gas having an undisturbed gas pressure of 1 atmosphere, rarefactions will be less than compressions, since the rarefactions cannot be less than vacuum. Consequently, an average pressure which is greater than the undisturbed pressure can exist at the pressure antinodes.

3. A practical and efficient way to achieve the high acoustical pressures needed for nonlinear operation, is to use ultrasonic sources. As mentioned above, high pressure high efficiency drivers are commonly available. Nonlinear effects can also be induced at sonic frequencies. However, at these lower frequencies, much larger driver displacements would be required to achieve high pressure waves. An added advantage of ultrasonic drivers is their silent operation.

Due to points 1 and 2 above, the relative pressure differential created between the nodes and antinodes becomes much more significant in the nonlinear mode of operation. In other words, the magnitude of this pressure differential, relative to the peak acoustic pressure of the wave, becomes greater in the nonlinear mode of operation.

In terms of efficiency, the ratio of the node-antinode pressure to the peak-to-peak acoustic pressure, becomes increasingly large in the nonlinear range. Consequently, the valveless embodiment's efficiency improves as it is driven further into the nonlinear region (i.e. higher pressure amplitudes). There will of course be a practical pressure limit, where dissipative forces will offset further efficiency gains. This behavior is most advantageous for compressor applications, since higher pressures represent greater efficiencies for the valveless embodiment.

In summary of the above three points, the ultrasonic nonlinear mode of operation provides a means to substantially increase the efficiency of the valveless embodiment.

The embodiment of the invention shown in FIG. 3 may operate in the ultrasonic non-linear mode, and requires no valves. Due to the nonlinear effects described above, a large pressure a differential will be established between pressure nodes and pressure antinodes. Consequently, low pressure gas will be drawn in at input port 4 and high pressure gas will be discharged at output port 6. For compression-evaporation refrigeration systems, the suction line from an evaporator would be connected to input port 4, and the discharge line to a condenser would be connected to output port 6. It should be noted that any number of input and output ports could be used in as in FIGS. 4–6, and that like-pressure-phase considerations are not required.

The following considerations are pointed out, concerning the various input/output port arrangements of the present invention. It is clear that the points of highest obtainable pressure in the pump housing, for valved or valveless arrangements, will be the pressure antinodes, which includes the end walls. As such it is desirable to place both valved and valveless output ports at these positions. It is also clear that the points of lowest pressure in the pump housing, for valveless arrangements, will be the pressure nodes. As such it is desirable to place valveless input ports at these points. For valved input ports, a lower pressure may be obtained at the pressure antinodes, including the end walls. Thus, the pressure nodes and antinodes provide ideal locations for input and output ports.

However, it is understood that the invention is not limited to a precise placement of input and output ports with respect to the pressure nodes and antinodes. Many valve and input/output port arrangements have been described above which make efficient use of the pressure effects associated with standing acoustic waves. These pressure effects are minimized or maximized at the pressure nodes and antinodes, but do not exist only at the pressure nodes and antinodes. Rather they can exist, although at reduced levels, at points removed from the pressure nodes and antinodes. In fact, any number of intermediate positions for input and output ports are possible. Although these intermediate positions can result in reduced pressure differentials and efficiencies, they can still provide an operable form of the present invention. Since both input and output ports can be operably moved to many intermediate locations, the exact location of input and output ports is not intended as a limitation on the scope of the present invention.

For all of the valved embodiments, attention must be given to conduit lengths, if valves are to be located some distance from the pump housing 2. It is pressure pulses which travel in these conduits. For optimal performance, these pulses should arrive at any common check valve at the same instant. Therefore, conduit lengths should be matched to this end.

A possible source of inefficiency in the present invention relates to an effect called "streaming." Streaming is a flow of the medium within pump housing 2 between nodes and antinodes, due to the pressure differential between these nodes and antinodes. It may be possible to minimize streaming losses by proper placement of input and output ports. Such placements could possibly reduce, or alternatively exploit, these streaming effects. Another consideration for minimizing streaming, is to keep the pump housing 2 as short as possible. Streaming occurs between each node and antinode. Therefore, by making the pump housing 2 only one or two half-wavelengths long, the energy lost to streaming can be minimized.

Electromagnetically Driven Embodiments

The absorption properties of a gas may be enhanced, by applying static electric or magnetic fields across the gas in the region of electromagnetic absorption.

Figure 11:
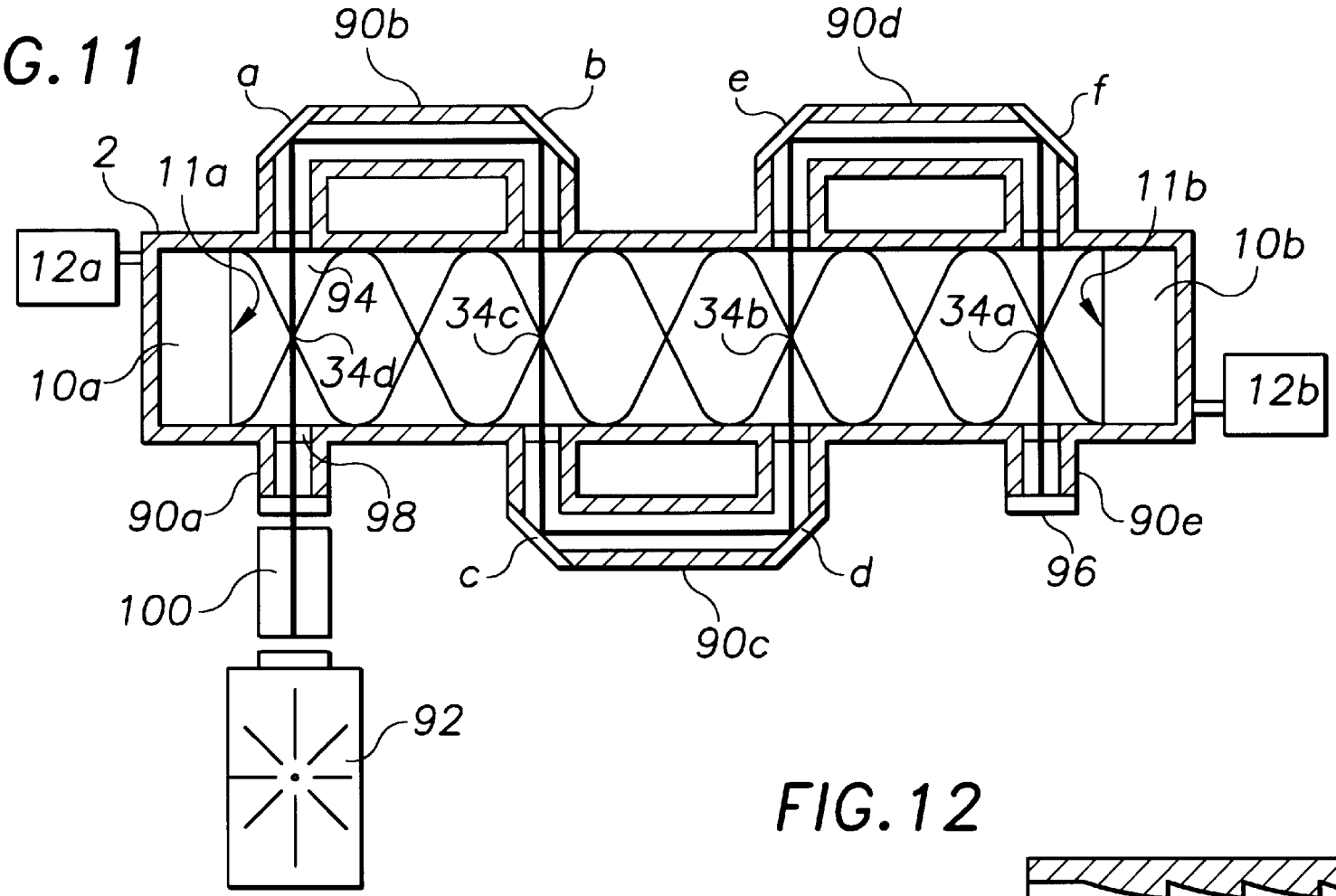
FIG. 11 shows an embodiment of the invention which provides a LASER as a means for maintaining a standing acoustical wave.

FIG. 11 illustrates an embodiment of the invention which provides a LASER driving means for maintaining a standing wave. For simplicity, FIG. 11 omits details of the various input and output ports, and valve arrangements described above. Thus, FIG. 11 is only intended to illustrate how electromagnetic energy can be used to establish a standing acoustical wave. It is understood that any of the electromagnetic drive arrangement of FIG. 11 can be used with the valved or valveless input and output port arrangements of FIGS. 1, 2, 3, 4, 5, 6, 7, 8, 9. When used in conjunction with the valveless embodiment, the following electromagnetic drive arrangements can provide a compressor which requires few moving parts.

FIG. 11 illustrates an embodiment of the invention which provides a LASER driving means for maintaining a standing wave. A pump housing 2 is provided which is transversely intersected at its alternate pressure antinodes by LASER beam guides 90*a*, 90*b*, 90*c*, 90*d*, 90*e*. The beam guides are equipped with reflective surfaces a, b, c, d, e, f which reflect the LASER beam at 90° angles, so that the LASER beam follows the beam guide. Identical optical windows 98, provide pressure seals between each of the beam guides and the interior of pump housing 2. Beam spreader 100 provides control of the LASER beam's cross sectional geometry so as to maximize the medium's exposure to the beam at the pressure antinodes. A LASER 92 emits LASER beam 94, so that LASER beam 94 passes in turn through beam spreader 100 then through optical window 98, and then is directed along the beam guide's 90*a* interior. The beam 94 then experiences multiple reflections due to reflective surfaces a, b, c, d, e, f and therefore propagates in turn through beam guides 90*a*, 90 b, 90*c*, 90*d*, 90*e*. Beam guide 90*e* is terminated by reflective surface 96, which reflects the beam through 180° causing it to return along the same path. Alternatively, beam guide 90*e* could be terminated by an absorber, which would absorb the beam's energy and prevent the beam's reflection.

In operation, the LASER beam 94 is pulsed, and so causes a periodic highly localized pressure increase of the medium. Hence, the periodic LASER pulses create pressure wavefronts which emanate from pressure antinodes 34*a*, 34*b*, 34*c*, 34*d* and propagate as longitudinal waves along the length of pump housing 2. The LASER pulses will have a repetition rate that will keep the instantaneous thermal excitation of the medium in phase with the pressure oscillations of the like-pressure-phase antinodes 34*a*, 34*b*, 34*c*, 34*d*. The pulses occur when said pressure antinodes are at their peak positive pressure, thus providing the correct reinforcement needed to sustain the standing wave. This method could be extended to any number of pressure antinodes, as long as these antinodes are all of like-pressure-phase. Alternatively, this present embodiment could be reduced to a single beam-pump housing intersection, as long as said intersection is located at a pressure antinode, and excites the medium in phase with its pressure oscillations, as described above.

LASER 92 could be a C02 LASER or an infrared LASER which could directly excite the medium's molecular vibrational states. An alternative driving means would be to locate individual IRLEDs at each of the like-pressure-phase antinodes, as long as they could provide enough power for a particular application. Also, solar energy could provide an abundant source of infrared radiation for driving the embodiment of FIG. 11.

In this embodiment the electromagnetically induced pressure increase of the medium is due to the electromagnetic excitation of the medium's molecular energy states. Molecular collisions serve to convert the energy of these excited molecular states into the increased kinetic energy of the gas. In short, any frequency of electromagnetic radiation can be used, as long as its absorption results in a change of pressure in the gas.

In the case of gases, the electromagnetic radiation absorption at a pressure antinode will be much higher than would be expected from the undisturbed pressure of the gas. In general, the electromagnetic radiation absorption of gases increases with the pressure and density of the gas. During operation, the electromagnetic radiation field is turned on when the pressure at the pressure antinode is at its maximum value, which is higher than the undisturbed pressure of the gas. Therefore, the electromagnetic radiation absorption coefficient of the gas at this instant will be greater than the absorption coefficient for the gas at its undisturbed pressure.

In the embodiment of FIG. 11, the source of electromagnetic energy is either pulsed or modulated at a rate which excites the desired acoustical mode. At the pressure antinodes, the pressure goes high once during a single cycle of the acoustic mode. If the electromagnetic energy is directed to the pressure antinodes, its pulse or modulation rate would be synchronized with the antinodes pressure cycle. In a paper by Chu and Ying (The Physics of Fluids, V6, p. 1625 1963), it is stated that a heat release whose periodic variation is twice that of the acoustic mode, will drive that mode. In either case, a simple change in modulation or pulse rate would provide proper operation of the present invention.

It is possible to drive a standing acoustic wave by applying electromagnetic energy of constant intensity to the pressure antinodes, as long as the desired acoustical mode is initially excited. Such an arrangement is described in a paper by Chu (The Physics of Fluids, V6, p. 1638 1963), wherein it is theoretically assumed that a pressure sensitive heat source is used. This means that as the gas pressure at the source increases, the amount of heat added to the gas by the source increases, thus adding energy in phase with the acoustic wave.

Such a pressure sensitive source is naturally accomplished in the present invention, when constant intensity electromagnetic energy is applied. The electromagnetic absorption of a gas varies with the pressure and density of the gas. Since the pressure and density of the gas at the pressure antinodes varies in phase with the acoustic wave, absorption will also vary in phase with the acoustic wave. Thus, energy will be added to the acoustic wave from a constant intensity electromagnetic field, as long as the desired acoustic mode is initially excited. One means by which to initially excite the desired acoustic mode would be to use a mechanical driver, such as a multi-layered pre-stressed high deformation piezoelectric transducer. Such a transducer could form one or preferably both end walls of pump housing 2 in the above figures. In some cases, the sudden application of the constant intensity field may be enough to provide initial excitation of the desired acoustical mode.

A constant field arrangement has the added advantage of not requiring a timing means, for keeping the pulsed or modulated electromagnetic source in phase with the pressure oscillations of the acoustic wave.

Valve Types

As described above, some of the embodiments of the present invention use check valves to complement their operation. It is understood that the term "check valve" refers to a function rather than to a specific type of valve. This function is essentially to rectify the oscillating pressure at the pressure antinodes into a net flow. Many different types of these rectifying components could be used; the exact choice of which depends on the particular design requirements of a given application.

In a practical system operating in the kHz acoustic range, reed valves can be employed. Reed valves which are commonly used on reciprocating type compressors, can be obtained from companies such as the Hoerbiger Corp. of America in Pompano Beach, Fla. Such companies supply reed valve assemblies complete with suction and discharge valves. These assemblies are typically sandwiched between the cylinder and head of a reciprocating compressor. A reed valve-head assembly like this could be used, for example, at either end wall 11*a* and 11*b* of pump housing 2 in FIG. 5, since each end wall 11*a* and 11*b* defines a pressure node 32. This valve assembly would also replace input port 4 and output port 6 of FIG. 3. However, care must be taken to make the suction and discharge openings small compared to the total area of end walls 11*a* and 11*b*. This will insure adequate reflection of the acoustic wave.

Figure 12:
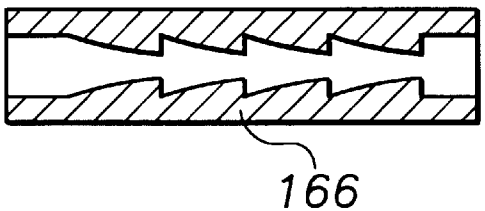
FIG. 12 shows an exemplary check valve which could be used in any of the valved embodiments of the invention.

Another type of valve is illustrated in FIG. 12 which shows a series connected restrictive orifice valve 155. This valve will provide a greater resistance to flow in one direction than in the other. Since the pressure at a pressure antinode is oscillating, the resulting oscillatory flow could be rectified by this orifice valve, thus giving a net flow in one direction.

In some applications, it may be desirable to drive a valved embodiment of the invention at an acoustic frequency which is higher than the response time of most standard valves. In such a case, the compressor's performance would suffer if the valves could not open fast enough to allow the medium to pass through. The orifice valve offers one solution to this problem. Another solution would be to employ an activated valve, which would open and close in response to an electrical signal. These activated valves would be operated by a control circuit, which would maintain a constant synchronization with the pressure oscillations of the standing wave. Activated valves could be made to open once per cycle, or once during a plurality of cycles. Such a valve could be activated by a piezoelectric element, which could provide high speed operation. Many other rectifying components may suggest themselves to one skilled in the art.

Instrumentation

Figure 13:
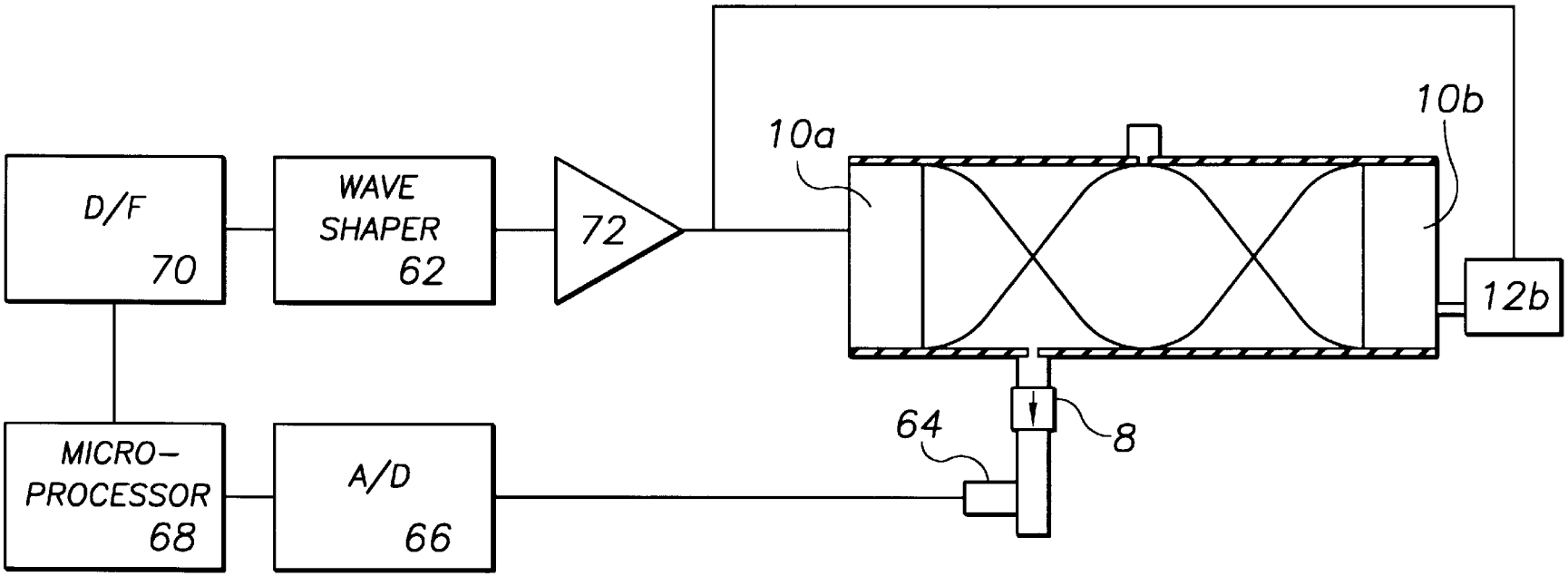
FIG. 13 shows a microprocessor based control circuit which can be used to maintain the proper driving frequency under changing conditions.
Figure 14:
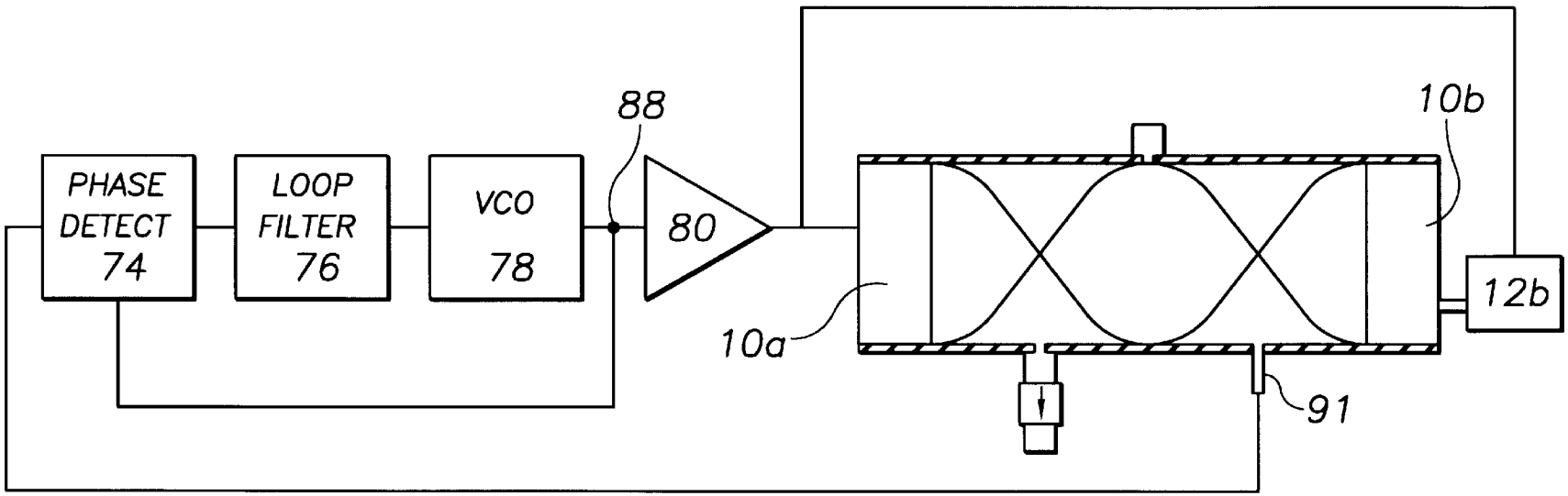
FIG. 14 shows a phase-locked-loop control circuit which can be used to maintain the proper driving frequency under changing conditions.

In all of the mechanically driven embodiments of the present invention, an automated frequency control of the driving system is necessary to assure optimal performance under changing conditions. An acoustic wave's velocity through a gas or liquid medium changes as a function of conditions such as temperature and pressure. As seen from the relationship lambda=v/f, if the velocity "v" of the wave changes, then the frequency "f" can be changed to keep the wavelength "lambda" constant. As described previously, there are certain preferred alignments between the standing wave's position and the input and output ports, which result in the optimal performance of the present invention. To preserve these alignments during operation, the wavelength must be held constant by varying the frequency in response to changing conditions inside the compressor. FIG. 13 and FIG. 14 illustrate two exemplary circuits, which could be used to maintain the required wavelength of the compression wave. Many other control circuits could be designed by those skilled in the art.

FIG. 13 is a microprocessor based control system, which monitors the compressor's output pressure with pressure sensor 64. The analog pressure signal is converted to digital information by analog-to-digital converter 66 and is then received by microprocessor 68. If the output pressure at sensor 64 is reduced due to the compressor's changing internal conditions, then in response the microprocessor's software sends digital information to the digital-to-frequency converter 70. Digital-to-frequency converter 70 then alters its output frequency to the value which will preserve the desired wavelength of the standing wave. Wave shaper 62 converts the digital-to-frequency converter's output wave shape into a wave whose shape fits a given design requirement. The output of wave shaper 62 is then amplified by amplifier 72 to a level sufficient for driving transducers 10*a* and 10*b*. In this way the wavelength is maintained at the desired value.

FIG. 14 is a phase-locked-loop control system which compares the phase of the driving waveform at point 88 with the phase of the pressure oscillations at an antinode 34. In the resonant condition, there exists a constant phase difference between the driving waveform at point 88 and the pressure oscillations at the antinode 34. Pressure sensor 91 located at antinode 34 supplies the oscillating pressure signal to the phase detector 74 to act as the reference signal. The driving signal is tapped off at point 88 and supplied to the phase detector 74 for comparison with the pressure signal. If the wavelength of the standing wave begins to change, then the phase difference between the two signals will begin to change. This phase change is measured by the phase detector 74, which in response sends a direct current voltage through the loop filter 76 to the voltage controlled oscillator 78. This direct current voltage causes voltage controlled oscillator 78 to vary its output frequency until the proper phase difference is regained, thus locking the voltage controlled oscillator to the proper frequency for resonance. The waveform generated by the voltage controlled oscillator 78 is amplified by amplifier 80 to a level necessary for driving transducers 10*a* and 10*b*. A wave shaper could also be added between point 88 and amplifier 80, if so desired.

The control systems of FIG. 13 and FIG. 14 can also be adapted to the electromagnetically driven embodiment of FIG. 11. In this case, the pulse repetition rate or the modulation frequency would be varied in response to system changes. The control system depicted is not limited to one control circuit providing the same input to both transducers. The control system of FIGS. 13 and 14 could also be modified to control the amplitude, phase and frequency of each transducer 10*a* and 10*b* independently or relative to each other to adjust the energy amplitude, phase or frequency of the standing compression wave.

Other parameters of the present invention could be used as control feedback for maintaining resonance. One such parameter is the current which drives transducers 10*a* and 10*b*. Since the transducers 10*a* and 10*b* draw less current at resonance, a minimum value of this current for a given output pressure would indicate resonance.

Furthermore, when the transducers 10*a* and 10*b* are piezoelectric crystals, then the pump housing, the acoustic wave, and the piezoelectric crystals, could all act together as the frequency determining element of a resonant circuit. For a given temperature and pressure, the transducer would tend to oscillate at the pump housing's acoustic resonance, thereby locking the resonant circuit's frequency at the pump housing's resonance.

Description of Refrigeration and Air-conditioning Applications

Figure 15:
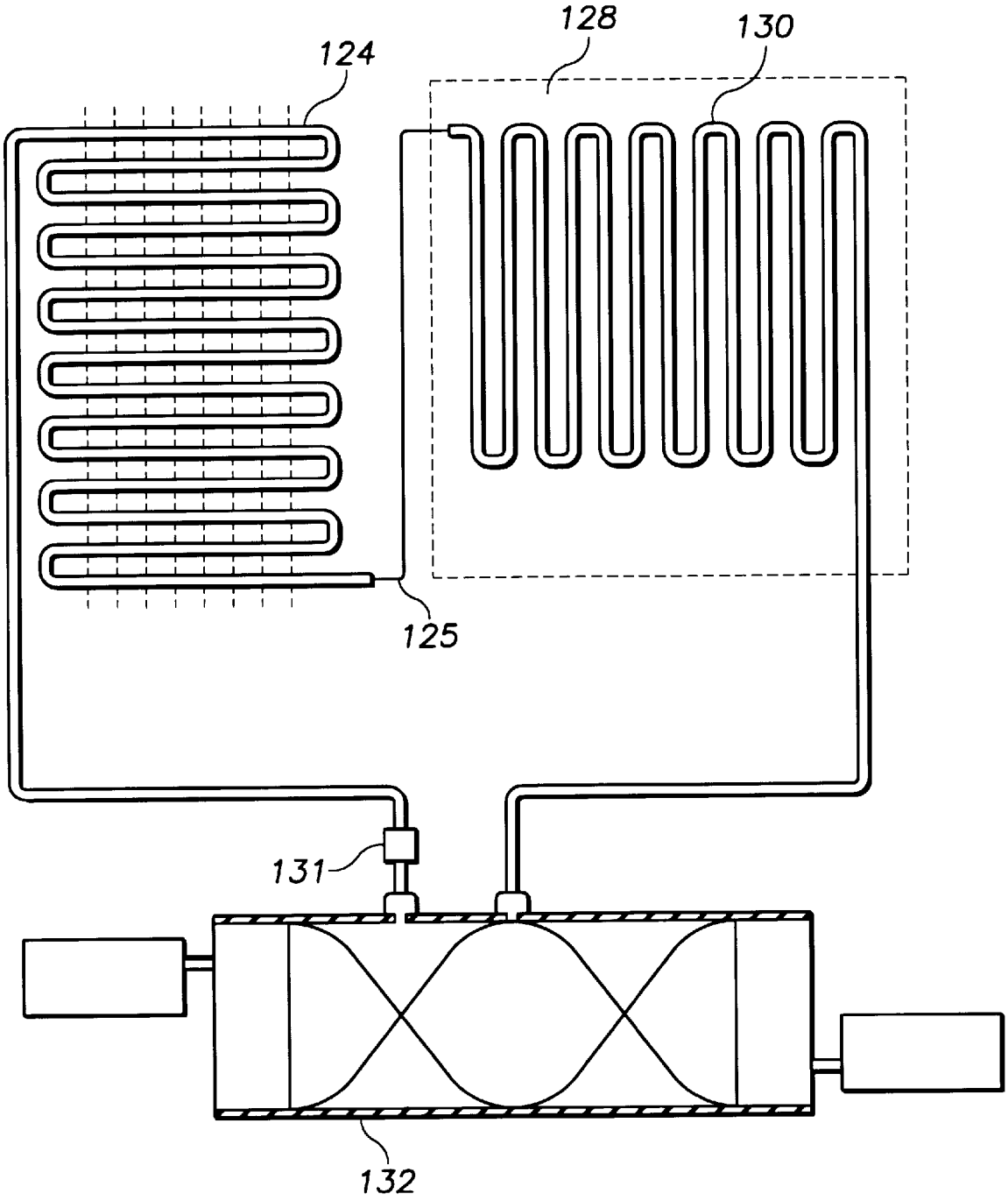
FIG. 15 illustrates the standing wave compressor as it is used in a typical compression-evaporation cooling system.

FIG. 15 illustrates the use of the present invention as a compressor, in a compression-evaporation refrigeration system. In FIG. 15 the present invention is connected in a closed loop, consisting of condenser 124, capillary tube 126, and evaporator 130. This arrangement constitutes a typical compression-evaporation system, which can be used for refrigeration, air-conditioning, or other cooling applications.

In operation, a pressurized liquid refrigerant flows into evaporator 130 from capillary tube 126, therein experiencing a drop in pressure. This low pressure liquid refrigerant inside evaporator 130 then absorbs its heat of vaporization from the refrigerated space 128, thereby becoming a low pressure vapor. Standing wave compressor 132 provides a suction, whereby the low pressure vaporous refrigerant is drawn out of evaporator 130 and into the standing wave compressor 132. This low pressure vaporous refrigerant is then acoustically compressed by standing wave compressor 132, and subsequently discharged into condenser 124 at a higher pressure and temperature. As the high pressure gaseous refrigerant passes through condenser 124, it gives up heat and condenses into a pressurized liquid once again. This pressurized liquid refrigerant then flows through capillary tube 126, and the thermodynamic cycle repeats.

Standing wave compressor 132 in FIG. 15, is shown to be the a single input and single outlet port embodiment of the present invention. However, various embodiments of the present invention can be used in the system of FIG. 15; the description and operation of which has been given above. The embodiment which is chosen, will depend on the design needs of a particular application. In general, the embodiments of the present invention can provide good design flexibility for a given system.

For some applications, it may be desirable to enclose the standing wave compressor, including the driving means, in a hermetic vessel.

When designing a system like that of FIG. 15, some advantage will be found in the choice of a proper base pressure of the standing wave compressor 132. This base pressure is the undisturbed pressure which exists inside the standing wave compressor 132, in the absence of an acoustic wave. Standing wave compressor 132 creates a pressure differential whose suction pressure is lower than the base pressure, and whose discharge pressure is higher than the base pressure. Thus to make the suction pressure equal to the pressure of evaporator 130, the base pressure should lie somewhere between the pressures of evaporator 130 and condenser 124. To provide added control over the base pressure of standing wave compressor 132, a pressure regulating valve 131 can be added to the discharge side of standing wave compressor 132. Pressure regulating valve 131 would limit the gas discharge of standing wave compressor 132. If pressure regulating valve 131 were constricted during operation, then for a brief period more gas would be drawn into standing wave compressor 132 than would be discharged. Therefore, the base pressure would rise, and a new equilibrium base pressure would be reached, which would be higher than the previous base pressure. Automatic control of pressure regulating valve 131 could be provided.

Solar energy comprises an excellent infrared source for driving the embodiment of FIG. 11. A simple solar arrangement could comprise a mirror for intensifying the sun's radiation, and a beam chopper to provide a pulse beam. This pulsed beam could be fed directly into beam guide 90*a* of FIG. 11.

Alternatively, the standing wave compressor can be driven by constant intensity electromagnetic energy, although the desired acoustical mode may need to be initially excited. Initial excitation of the desired acoustical mode, could be accomplished by a mechanical driver, such as the driver shown in FIG. 3. In some cases, the sudden exposure to the constant intensity electromagnetic energy may be enough to initiate the desired acoustical mode. Self initiation of the desired acoustic mode becomes more reliable if more than one pressure antinode is driven by the constant intensity source. Multiple antinode driving would tend to lock in the desired mode. Constant intensity driving provides great simplicity for the solar driven embodiments, since the pulsing means can be eliminated. In general, a pulsed source would represent greater efficiency. However, since solar energy is free, the added simplicity of a constant source becomes more desirable.

Several solar driven standing wave compressors could be placed in series to provide higher pressure differentials, or in parallel to provide higher net flow rates. The solar driven embodiments could also find applications in outer space, where intense infrared energy from the sun is plentiful.

A mechanical drive could be combined with a solar drive to provide a hybrid heatpump system. For example, the standing wave compressor could be driven by both an ultrasonic driver, and by solar energy. In the absence of sunlight the ultrasonic driver would provide most of the energy needed to drive the standing wave compressor. On sunny days, the energy consumption of the ultrasonic driver could be supplemented by solar energy. The solar infrared energy would be directed to the pressure antinodes as described above. This hybrid drive standing wave compressor could operate in three modes: (1) all mechanically driven, (2) all solar driven, (3) both mechanically and solar driven at the same time. Mode selection could be varied automatically in response to ongoing operating conditions.

Alternatively, a solar driven standing wave compressor could act as a pre-compressor for other conventional compressors, thereby reducing the pressure differential which must be provided by the conventional compressor, during sunlit hours.

Since the standing wave compressor eliminates all moving parts which require oil, a compression-evaporation system can be operated with an oil-free refrigerant. Thus, the many system design problems associated with oils can be eliminated, and a compression-evaporation system could approach more closely the efficiency of an ideal refrigeration cycle.

Compression-evaporation cooling equipment can take many forms and is found in many different applications and industries. As such, the standing wave compressor is not limited only to those cooling applications described above, but can be adapted to any number of applications.

Thus the reader can see that the present invention successfully provides a simple yet efficient and adaptive compressor, which does not suffer from the many disadvantages of numerous moving parts. In particular, the reader can see that a valveless version of the present invention can operate with increased efficiency in its ultrasonic nonlinear mode. The reader can also see that the electromagnetically driven embodiments, provide a compressor which minimizes internal moving parts, and can be driven by sources of electromagnetic energy, including solar energy. Finally, the reader can see that the present invention provides an oil-less compressor which is particularly well suited for compression-evaporation cooling systems.

While the above description contains many specifications, these should not be construed as limitations on the scope of the invention, but rather as an exemplification of one preferred embodiment thereof. Many other variations are possible, and may readily occur to those skilled in art. For example, additional transducers could be placed in an intermediate position in the pump housing, such that standing compression waves could be set up on both sides of the transducer. Also, the waveforms that drive either single or multiple transducers need not be sinusoidal, but could be sawtooth, square wave, pulsed, or any waveform that satisfies a given design need.

In addition, the pump housing 2 need not be cylindrical, but can be any geometry which will support a standing acoustical wave. Also, various features could be added to the control instrumentation. For example, the driving system's power could be varied in response to changing cooling load demands. This feature would provide all of the advantages associated with contemporary "variable speed compressors."

Input and output ports may also be formed in different geometries, and thus could define openings in pump housing 2 such as a series of circular holes, slits, indentations, or separate adjoining pump housings. Alternatively, coaxial tubes with periodic openings at the nodes and antinodes could be used to locate input and output ports along the axis 29 of the pump housing 2.

Finally, several units can be connected so that their inputs and outputs form series and/or parallel combinations, and their pump housings could intersect at common pressure antinodes, all of which can provide greater pressure differentials and improve volume handling capabilities. Accordingly, the scope of the invention should be determined not by the embodiments illustrated, but by the appended claims and their equivalents.

I claim:

1. A standing wave pump comprising:

a pump housing for holding a fluid to be pumped;

said pump housing having a first end and a second end;

said pump housing having an outlet and an inlet;

wave generating means for establishing standing planar compression waves in said fluid in said pump housing;

said wave generating means comprising a first reflective emitter and a second reflective emitter;

said first reflective emitter being located at said first end of said pump housing;

said second reflective emitter being located at said second end of said pump housing in opposing relationship with said first reflective emitter;

wherein said first reflective emitter generates a first planar pressure wave of a first wavelength and a first energy amplitude in said fluid, said first energy amplitude being sufficient to reach and be reflected by said second reflective emitter;

and wherein said second reflective emitter generates a second planar compression wave of a second wavelength and a second energy amplitude in said fluid;

said second energy amplitude being sufficient to reach and be reflected by said first reflective emitter;

and wherein said second reflective emitter is separated from first reflective emitter by a distance equal to an integer multiple of half said first wavelength or an integer multiple of half said second wavelength;

whereby said first and second planar compression waves are generated and reflected simultaneously, thereby generating a standing compression wave with a third energy amplitude;

said third energy amplitude being greater than either said first energy amplitude or said second energy amplitude;

said standing compression wave having one or more pressure nodes therein; and said standing compression wave having one or more pressure antinodes therein.

2. The standing wave pump of claim 1;

wherein said inlet is located at said pressure node;

and wherein said outlet is located at said pressure antinode.

3. The standing wave pump of claim 2, wherein said first reflective emitter and said second reflective emitter each comprises a highly deformable piezoelectric transducer.

4. The standing wave pump of claim 3, wherein said first reflective emitter or said second reflective emitter further comprises a diaphragm between said piezoelectric transducer and said pump housing;

said diaphragm in mechanical communication with said piezoelectric transducer; and said diaphragm in communication with said fluid in said pump housing.

5. The standing wave pump of claim 2, wherein said highly deformable piezoelectric transducer comprises a multilayer prestressed piezoelectric transducer, said multilayer prestressed piezoelectric transducer further comprising:

an electroactive ceramic member with first and second opposing major faces, each of said major faces being electroplated; and a prestress layer bonded to a first major face of said electroactive ceramic member;

wherein said prestress layer applies a compressive force to said electroactive ceramic member in a direction parallel to said first major face.

6. The standing wave pump of claim 5, wherein said wave generating means further comprises an adjustable voltage source for applying a voltage across said electroactive ceramic member, said voltage source in electrical communication with each of said electroplated major faces.

7. The standing wave pump of claim 6, further comprising:

pressure sensing means for sensing a pressure within said pump housing;

said pressure sensing means being in communication with said fluid in said pump housing; and said pressure sensing means comprising signal generating means for generating a signal in response to a pressure sensed within said pump housing;

regulating means for adjusting said voltage source;

said regulating means being in electrical communication with said voltage source; and said regulating means being in electrical communication with said signal generating means;

whereby said regulating means may adjust a voltage applied across said electroactive ceramic member in response to said signal generated in response to a pressure sensed within said pump housing.

* * * * *